US008127678B2

(12) United States Patent
Alt-Steiner et al.

(10) Patent No.: US 8,127,678 B2
(45) Date of Patent: Mar. 6, 2012

(54) METHOD AND APPARATUS FOR PROVIDING INFORMATION ABOUT PRINTING PLATES TO BE MANUFACTURED FOR A NEW PRODUCTION OF A PRINTING PRESS

(75) Inventors: Adrian Helmut Alt-Steiner, Würzburg (DE); Andreas Kunzemann, Güntersleben (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/737,276

(22) PCT Filed: Jun. 24, 2009

(86) PCT No.: PCT/EP2009/057859

§ 371 (c)(1),
(2), (4) Date: Feb. 11, 2011

(87) PCT Pub. No.: WO2009/156417

PCT Pub. Date: Dec. 30, 2009

(65) Prior Publication Data

US 2011/0126726 A1 Jun. 2, 2011

(30) Foreign Application Priority Data

Jun. 26, 2008 (DE) ..... 10 2008 002 681

(51) Int. Cl.
*B41F 27/12* (2006.01)

(52) U.S. Cl. ..... 101/477; 101/DIG. 46

(58) Field of Classification Search ..... None
See application file for complete search history.

(56) References Cited

U.S. PATENT DOCUMENTS

| | | | |
|---|---|---|---|
| 4,727,807 | A | 3/1988 | Suzuki et al. |
| 5,937,149 | A | 8/1999 | Lindner et al. |
| 6,257,141 | B1 | 7/2001 | Hashimoto et al. |
| 6,505,556 | B2 | 1/2003 | Miyauti |
| 7,159,516 | B2 | 1/2007 | Schneider et al. |
| 2002/0050216 | A1 | 5/2002 | Miyauti |
| 2006/0225594 | A1 | 10/2006 | Thoma |
| 2006/0254447 | A1 | 11/2006 | Schneider et al. |

(Continued)

FOREIGN PATENT DOCUMENTS

| | | | |
|---|---|---|---|
| DE | 10314341 | B3 | 8/2004 |

(Continued)

*Primary Examiner* — Joshua D Zimmerman
(74) *Attorney, Agent, or Firm* — Mattingly & Malur, P.C.

(57) ABSTRACT

A method and an apparatus are used for providing information about printing plates to be manufactured for a new production of a printing press. A use of at least one of the printing plates, at its point of use in the printing press, is visualized on a display of a display apparatus. Several different positions exist at the point of use of each respective printing plate. Each of those different positions may relate to one of several installation positions on a plate cylinder comprising the several installation positions and disposed in the printing press. These can also relate to one of several storage positions of a printing plate magazine of the printing press comprising several storage positions. By use of the display, several different points of use in the printing area, for a particular printing plate, are displayed simultaneously. The display depicts which one of the positions of use, of the several possible provided parts of use, is to be provided. The display additionally depicts different states or properties of at least one printing plate that has been manufactured or that is to be manufactured. It may also depict a print location of a printing plate on a transport path to the printing press.

22 Claims, 10 Drawing Sheets

U.S. PATENT DOCUMENTS

2009/0000503 A1 1/2009 Gretsch

FOREIGN PATENT DOCUMENTS

DE 102006006136 A1 8/2007
EP 1002646 A1 5/2000
EP 1435292 A1 7/2004
GB 2316912 A 11/1998
GB 2424392 A 9/2006
WO 2004085153 A2 10/2004
WO 2007/090732 A2 8/2007
WO 2007/090732 A3 8/2007

METHOD AND APPARATUS FOR PROVIDING INFORMATION ABOUT PRINTING PLATES TO BE MANUFACTURED FOR A NEW PRODUCTION OF A PRINTING PRESS

CROSS-REFERENCE TO RELATED APPLICATIONS

This application is the U.S. national phase, under 35 U.S.C. 371, of PCT/EP2009/057859, filed Jun. 24, 2009; published as WO 2009/156417 A2 and A3 on Dec. 30, 2009, and claiming priority to DE 10 2008 002 681.6, filed Jun. 26, 2008, the disclosures of which are expressly incorporated herein by reference.

FIELD OF THE INVENTION

The present invention is directed to methods for providing information about printing formes which are to be manufactured for a new production run of a printing press and to corresponding devices.

A use of at least one of the printing formes, at its location of use in the printing press, is visualized in a display of a suitable display device. A plurality of different positions exist at the location of use of the particular printing forme. Each of those positions can relate to one of multiple mounting positions on a forme cylinder that is arranged in the printing press and that has multiple mounting positions. Alternatively, each such position can be one of multiple storage positions in one of multiple chutes having the relevant storage position. Those chutes are disposed in a printing forme magazine that is assigned to one of the forme cylinders of the printing press. The display can simultaneously depict a plurality of different locations of use in the printing press. The display also depicts at which of these positions of a specific location a printing forme is to be provided.

BACKGROUND OF THE INVENTION

It is known, from DE 10 2006 006 136 A1, or WO 2007/090732 A2, to evaluate, in an evaluation unit having electronic data processing capabilities, image data which has been acquired from individual printing formes by linking such data with additional data also provided to the evaluation unit by a production planning system. This can be done in order to determine whether a printing forme magazine, which is arranged in a printing press, is loaded with the proper printing formes for a planned production run. This examination includes determining whether the printing forme, which is required for the planned production run, is stored in a chute of the printing forme magazine. The evaluation unit is connected to a signaling apparatus, on which signaling apparatus the evaluation unit either displays at least a detected inconsistency between the detected, actually stored printing forme and a printing forme that is required at this position for the planned production run, and/or generates a corresponding message that is perceptible to operators of the printing press. The signaling apparatus can contain at least one of a visual and an acoustic display.

A method and a device for providing information about printing formes to be manufactured for a new production run of a printing press is known from US 2002/0050216 A1. The respective identification code on printing formes mounted on forme cylinders of a rotary printing press, which code is applied during the exposure of each of the formes, is scanned and is compared with position data that is assigned to the respective printing forme for a specific production run. If an incorrect loading at a mounting position on one of the forme cylinders is detected, an error message will be generated on a display device.

A device for storing a packing to be exchanged on a cylinder of a printing press is known from WO 2004/085153 A1. A plurality of packings are to be arranged on the cylinder. The packing that is to be exchanged, is stored in a holding device. This holding device has at least one code reader. That code reader scans a feature, which was previously applied to the packing for the purpose of its identification. A control unit then matches the scanned feature to a loading plan for the intended printing process, and also checks all of the packings which are stored in the holding device to determine whether the packings in the holding device are stored in the proper sequence for the intended printing process. The control unit then generates a message warning of an improper mounting, at least in the event of an inconsistency in the comparison, and before the packing is mounted on the cylinder.

A method for supplying printing formes to a cylinder is known from EP 1 435 892 A1. A loading plan for the printing formes to be supplied to the respective cylinder is stored in a memory. A coding of the respective printing formes is compared with the loading plan. The printing formes are supplied to the cylinder according to the loading plan.

A device for assigning printing plates to mounting positions in a rotary press is known from EP 1 002 646 A1. A printing forme, which is identified by its page number, is assigned to a mounting site on the rotary press by linking that forme with an imposition scheme. The mounting site for this printing plate, as determined by mechanical means, is displayed. The mounting position cannot be determined from the coding which has been applied to the printing plate.

A method for operating a system at least for supplying at least one printing forme stored in a printing forme magazine to a cylinder is known from DE 103 14 341 B3. A code reader scans a code on the printing forme. Errors, such as a double loading or an improper loading of a print position on the cylinder, can be identified from a message which is sent by the system, preferably to a control center of the printing press.

A device for automatically changing printing formes on a cylinder of a printing press is known from U.S. Pat. No. 4,727,807 A. A plurality of printing formes are to be arranged on the cylinder. Printing formes, which are suspended from a transport system, and which are to be supplied to a printing couple, are removed at the printing couple to which they are assigned. These printing formes are intermediately stored in a container, once a code reader has read a code that is applied to each such printing forme and has determined its assignment to the printing couple.

SUMMARY OF THE INVENTION

The problem which is addressed by the present invention is that of providing methods and devices for providing information about printing formes that are to be manufactured for a new production run of a printing press, and which enable an overview and the control of the printing formes to be manufactured for the new production run of the printing press.

The problem is solved, in accordance with the present invention by using the display to provide information with respect to different states or properties of at least one of the manufactured printing formes. The display can simultaneously depict multiple different production runs that are to execute sequentially in the same printing press, with a plurality of the locations of use, assigning to those production runs, for the printing formes that are required for the respective production runs. The display additionally displays a position which is currently occupied by at least one printing forme, which has been or which will be manufactured, on its transport path to the printing press.

The advantages to be achieved, in accordance with the present invention, consist, in particular, in that the method and the device enable an overview and the control of the printing formes to be manufactured for a new production run of the printing press. The printing formes, which are provided at different times and with at least one print image, can be stored, presorted, and can be provided together to the printing press in sets, as needed, with respect to a planned production run. An operator, who is setting the printing press up for a pending production run, thereby saves the time he would otherwise be required to spend for sorting printing formes, which printing formes are, in practice, frequently manufactured in any random sequence, for example in newspaper printing. The time he would otherwise require for completing an integral set of printing formes, which are required at a specific one of multiple possible locations of use, for example, on a specific forme cylinder or in a specific printing forme magazine of the printing press is also saved. As a result, a shorter set-up time is achieved, thereby improving the efficiency of the printing press. The full flexibility of the sequence of the printing formes to be manufactured is maintained, which flexibility is particularly important for newspaper printing. In addition, an operator of the printing press has a full overview of, and control over, the printing formes to be manufactured for a new production run of the printing press. Such overview exists at all times during preparation for a new production run of the printing press, on the basis of information displayed on a display of a display device.

In preparing to process a print order, a plurality of printing formes generally must be manufactured for use in a printing press. More particularly, in a print operation, typically for producing a newspaper as the printed product in an offset printing press, a plurality of printing formes are required within a short period of time for use on one of the forme cylinders of the offset printing press. The printing formes which are to be used, are frequently manufactured by exposing plate-type blanks in a plate exposure device, which is separate from the offset printing press. A corresponding master, for example, is provided by a computer of a print prepress, preferably electronically, in the form of a file, and is supplied to the plate exposure device, to form at least one print image. The print image, which is applied to the respective blank, is developed photochemically, for example, in a developing unit, thereby forming it permanently. The printing formes, each of which is provided with at least one print image, are then each preferably bent in a bending unit, and preferably are each bent at two opposite ends, thereby forming suspension legs. Each respective printing forme can be attached to an outer surface of a relevant forme cylinder by the use of its suspension legs, which angled or bent suspension legs can be inserted into at least one groove that is formed on the relevant forme cylinder. To assist with aligning the printing forme in the proper position on the outer surface of the relevant forme cylinder, that particular printing forme can also be equipped with at least one register punch or with one notch or clip, which punch or notch or clip is formed in the forme particularly prior to the bending of at least one of its suspension legs. After it has been exposed, developed, bent and optionally has been punched and/or clipped, the respective printing forme is then ready for use in a production run in the offset printing press.

An offset printing press which may be used in newspaper printing has, for example, a plurality of printing couples which are arranged, in sequence, in the direction of transport of the print substrate, such as, for example, a material web, and particularly a paper web, which is to be printed with the respective print image of the printing formes. Each such printing couple has at least one forme cylinder and at least one transfer cylinder cooperating with the associated forme cylinder. Such multiple printing couples are used, for example, for executing a multicolor printing process, such as, for example, for executing a four-color printing process. In the case of double-sided printing of the print substrate, which double-sided printing is preferably executed simultaneously on both sides of the substrate, the number of printing couples, which are required in the printing press, is doubled. Each forme cylinder of each one of the printing couples can be loaded, at least in its respective axial direction, with a plurality of printing formes, such as, for example, with four or six printing formes. Each of the printing formes is assigned to precisely one axial mounting position on the outer surface of said forme cylinder. In its respective circumferential direction, each of the forme cylinders can also be loaded, at specific axial positions, with a plurality of printing formes, such as, for example two or three printing formes. Each forme cylinder thus has multiple circumferential mounting positions, one in front of the other in the circumferential direction, and each for receiving one of the printing formes. The outer surface of the forme cylinder therefore may have a total of, for example, eight, twelve, or more mounting positions, each for the receipt of one printing forme. In an offset printing press having eight printing couples, for example, and wherein each of which printing couples has, for example, one forme cylinder, with, for example, twelve mounting positions, each for one printing forme, a total of 96 printing formes are to be arranged on the forme cylinder when all of the mounting positions are in use. The number of printing formes, which are required for executing a specific print order, is increased in most cases because, and specifically is increased in newspaper printing, because, rather than using a single printing unit having, for example, eight printing couples, a plurality of such printing units, which are combined to form a complex printing system, are used, with each such printing unit having, for example, eight printing couples. The essentially sequential manufacturing of such a number of printing formes, ready for use for the intended production run, requires a considerable amount of time to accomplish before the relevant printing formes are themselves ready for arrangement on the outer surface of the relevant forme cylinder. For various economic reasons, however, simply increasing the number of plate exposure devices, which can be used in parallel, and preferably simultaneously, for example, is not a feasible solution.

To facilitate the assignment of the printing formes, which have been manufactured in the plate exposure device, for their respective arrangement on the outer surface of one of the forme cylinders of the offset printing press which is being set up for a specific production run, each of the printing formes, that are relevant to a specific production run, for example, are preferably provided, in the plate exposure device, with coding. Such coding is preferably formed in a non-printing area of the relevant printing forme. For example, the respective coding may be located on one of the suspension legs that is to be formed on the relevant printing forme. The coding can be embodied, for example, in the form of a machine readable, and particularly in the form of a two-dimensional data matrix code or 2D code, or alternatively or additionally in the form of plain text that can be read by humans. In particular, the information which is contained in the code, provides information about in which printing couple of the offset printing press the relevant printing forme is to be arranged, on which forme cylinder, and at which mounting position, all for the specific purpose of executing the pending print order. The information that is contained in the code can also provide information about the printed product itself or can provide information about a page number relating to the relevant printed product, together with additional information, such as, for example, the production date of the relevant printing forme. The coding is applied to the printing forme, for example, in the plate exposure device, and during the same process step in which the print image is applied to the relevant printing forme.

The manufacturing of the printing formes, which relate to a specific production run, is preferably controlled on the basis of data that has been provided, for example, by a control unit of a production planning system. Such a control unit of the production planning system is connected to the plate exposure device, for example, via an electronic cable-connected or wireless communications system. It is also preferably connected at least to a control center belonging to the offset printing press, for the purpose of data exchange. The data that is provided by the control unit of the production planning system, and which is also called production data, identifies the printed product to be produced in terms of at least one, and preferably in terms of several, of its characteristics, such as, for example, its page number, and also provides information about the number of copies of that printed product which are to be produced in a specific production run. The production data, which is assigned to a specific production run, can also contain information about the print substrate that will be used, such as, for example, the type of paper and/or its base weight. It can further contain information about the printing press that will be used, such as, for example, information about the diameter of the forme cylinder and/or the transfer cylinder, and information about the loading configuration of printing formes on the forme cylinder which is involved in executing the pending print order. Such information may include, for example, which printing forme is to be arranged at which mounting position on the relevant forme cylinder, and information about a production speed to be run on the printing press. It can further include information about the planned start of production, and/or about the mode of production to be accomplished on a folding unit which may be situated downstream of the printing process. That information may include, for example, whether the particular folder will be used in collect production or in straight run production. Based upon the production data that is supplied to the plate exposure device, the printing formes, which are required for a specific production run, are produced at the proper time. They are then supplied to the relevant forme cylinder based upon their respective coding.

The printing formes, which may be required for a specific production run, are supplied to the printing press, for example, in at least one mobile collection container, in which container, the printing formes that are required on a specific forme cylinder, are preferably stored as a set, such as, for example, as a complete, integral unit of printing formes which are to be transported together to the relevant forme cylinder. In practice, a plurality of at least similar mobile collection containers is available on the production line for manufacturing printing formes ready for use.

Alternatively, the printing formes, which may be grouped into sets, can also be transported manually to their respective locations of use in the printing press. The printing formes, which are preferably transported in one of the collection containers to the relevant forme cylinder, are supplied to the relevant forme cylinder manually by an operator. They may also be supplied to their respective mounting position on the relevant forme cylinder, and can be positioned there, automatically by the use of a controllable conveyor device.

The flexibility in creating the master for producing the printing forme would be unduly restricted if the printing formes, which may be required for a specific forme cylinder, had to be manufactured in uninterrupted sequence in order to be supplied logically with one of the collection containers, for example, to its respective location of use in the printing press, and ultimately also to its respective mounting position on the relevant forme cylinder. It is therefore advantageous to expand the device, which is required for manufacturing printing formes ready for use, which device comprises, for example, at least one plate exposure device, at least one developing unit, and at least one bending unit, by adding to it at least one storage device, in which printing formes, each of which is provided with at least one print image, can be intermediately stored until an integral set of printing formes has been fully manufactured and has been assembled for transport together to a specific forme cylinder. A check is performed, on the basis of the data which has been provided by the control unit of the production planning system, for example, to ensure that all of the printing formes belonging to a specific set have been provided. The storage device is also preferably connected to the previously discussed communications system.

The storage device is arranged downstream of the plate exposure device in a production line for use in manufacturing the printing formes, for example, and upstream of the bending unit. This is done because flat printing formes, that have not yet been bent, can be stored in less space, and also because the risk of mutual damage, such as, for example, scratching of a print image by a suspension leg, for example, is avoided. Alternatively, the storage device can also be arranged downstream of the bending unit in the production line. Such positioning is appropriate particularly if the intention is to achieve a rapid removal of the plates from storage, and if a savings of space, which may be achieved by storing unbent, flat printing formes, has a lower priority in the embodiment of the storage device than the intended rapid removal from storage of printing formes which have been stored in the storage device. This is because the bending process, which is implemented by the bending unit, requires significantly more time than other processes, and particularly transport processes, combined with the removal from storage of printing formes that have been stored in the storage device.

The storage device is preferably embodied in such a way that printing formes can be placed in storage and can also be removed from storage simultaneously. At least one of the printing formes can be placed in the storage device, while, at the same time, another of the printing formes can be removed from the storage device. The storage device has at least as many storage spaces as the number of printing formes belonging to a set of printing formes. The number of printing formes belonging to the same set does not need to be identical to the maximum number of mounting positions on the forme cylinder which may be involved in the pending production run. Rather, the relevant set of printing formes comprises as many printing formes as are to be exchanged and/or attached, in the same working process, to the forme cylinder that is involved in the pending production run. The storage device is preferably equipped with enough storage spaces to hold a plurality of sets of printing formes, such as, for example, all of the sets of printing formes that can be used in the relevant printing press. In one preferred embodiment, for example, the storage device has several hundred such storage spaces and may have, for example, four hundred or more, such storage spaces for printing formes. The storage spaces of the storage device can each be addressed or accessed individually. A loading of each individual storage space with one printing forme is registered by at least one sensor for each such space. The storage device therefore preferably has an electronic control unit connected to the communications system. This control unit monitors or controls the placement in storage processes and the removal from storage processes, together with the assignment of printing formes to the storage spaces of the storage device. It also stores information about the loading of the individual storage spaces, and shares that information with other computers, such as, for example, with a control center belonging to the printing press, by use of the communications system.

Printing formes belonging to different sets, and which have been stored in the storage device, are preferably removed from storage in uninterrupted sequence as an integral set of printing formes. This is accomplished regardless of whether such printing formes have been presorted beforehand in the storage device into integral sets of printing formes, or have been stored in storage spaces in the storage device in a chaotic, or random arrangement. If the printing formes, which have been stored in the storage device, are not originally unloaded in sets, then a sorting station that sorts the printing formes according to their required sets is provided, for example, immediately after the removal of the printing formes from said storage device. The sorting station can be embodied as an independent device, which may be separate from the storage device. The sorting station also preferably has a control unit, which is connected to, or at least which can be connected to the communications system. The sorting station, which may be embodied as a carousel, for example, or the storage device, groups its printing formes, which are supplied to it automatically, for example, on the basis of the coding that preferably has been applied to each of the printing formes, into integral sets. These sets are, in turn, to be supplied, in the same operating process, to the relevant forme cylinder, and particularly with one of the mobile collection containers. Alternatively, the sorting station, which sorts the printing formes into sets that are ready for use, is arranged downstream of the bending unit in the production line. That sorting station either delivers the printing formes, that have been grouped into sets ready for use, for example, to one of several mobile collection containers which may be standing ready at the sorting station, or uses the multiple mobile collection containers, which may be standing ready at said sorting station, to sort the printing formes into sets of printing formes which are now ready for use.

To assist, for example, with the proper loading of the mounting positions to be used in a pending production run on the relevant forme cylinder, a display device can be provided. Such a display device displays, for example, visually, and particularly displays graphically, and preferably using at least one symbol, in an overall display showing the multiple mounting positions simultaneously, at which one of these multiple mounting positions on the relevant forme cylinder or at which one of multiple storage positions in a printing forme magazine, which magazine delivers printing formes to the relevant forme cylinder, one of the printing formes that has been manufactured or at least that will be manufactured, for example, is to be arranged.

In particular, the display of the display device can also be used to display different states and/or different properties relating to at least one of the printing formes that has been manufactured or at least that will be manufactured. The display device can, for example, depict to which mounting position on the relevant forme cylinder or to which storage position in the printing forme magazine an already manufactured, ready-to-use printing forme is assigned. It can also display to which mounting position on the relevant forme cylinder or to which storage position in the printing forme magazine a printing forme that is currently in its manufacturing process, and that is, for example, in the supply line, is assigned. The display of the display device can also depict at which mounting position on the relevant forme cylinder, or at which storage position in the printing forme magazine a printing forme is to be mounted for the planned new production run. It can additionally display which mounting position on the relevant forme cylinder, or which storage position in the printing forme magazine will not be loaded with a printing forme during the pending production run. This may occur because, in the pending production run, for example, a print substrate, having a print substrate width that does not utilize the full printing width of the relevant forme cylinder, may be used. Additionally, the display device can display at which mounting position on the relevant forme cylinder, or at which storage position in the printing forme magazine a non-printing printing forme, such as, for example, a so-called dummy plate, will be arranged. The display device can draw the information necessary for its respective display, for example, from the data that may be provided by the control unit of the production planning system, preferably comparing that data with the data which was collected during the manufacturing of the printing formes that have been prepared for the pending production run. The display device may be arranged, for example, in the area of the location at which the mobile collection container receives the printing formes relating to a specific forme cylinder, and prior to the transport of those formes to the relevant forme cylinder. The display device can also be used to display the current status of the printing formes which are to be manufactured for a specific production run, and thus may be used, for example, to display whether a specific printing forme is currently located, for example, in the plate exposure device, in the developing unit, in the bending unit, or in the storage device. The display of the display device therefore particularly indicates to an operator of the printing press whether or not a set of printing formes, which may be required for a specific forme cylinder, is complete. The display device can also display for which printing unit, preferably comprised of multiple forme cylinders, in a complex printing system, such as one that is comprising multiple printing units, at least one set of printing formes is already complete, and/or can display which of the multiple sets of printing formes, that are to be arranged in a specific one of the printing units, has already been manufactured and is ready for use.

To further assist, for example, with the proper loading of printing formes on the mounting positions which are to be used in a pending production run on the relevant forme cylinder and having multiple mounting positions, each for receiving one printing forme, an information field can be provided, for example, on at least one printing forme, and preferably on multiple printing formes, and more particularly on each of the printing formes to be arranged on the relevant forme cylinder. Such an information field contains information about the loading of the relevant forme cylinder, in at least one mounting position that is adjacent to its own provided mounting position. Thus, the information field, which is applied, for example, by the plate exposure device, preferably in a non-printing area, and particularly which is applied on the suspension leg of the relevant printing forme, can display, for example, at which mounting position on the relevant forme cylinder or at which storage position in the printing forme magazine the printing forme containing that information field is to be arranged. It can also display at which other mounting position on the relevant forme cylinder, or at which other storage position in the printing forme magazine that stores the particular printing forme, an additional printing forme, which is currently to be manufactured, is to be arranged. It can further display at which mounting position on the relevant forme cylinder, or at which storage position in the printing forme magazine which stores the printing forme, no new printing forme is to be mounted currently, such as, for example, for the pending production run, and instead at which position, the printing forme, already present, will be left in place. The information field can also display which mounting position on the relevant forme cylinder, or which storage position in the printing forme magazine that stores the printing forme, will not be loaded with any printing forme for the pending production run, because in the pending production run, for example, a print substrate having a print substrate width that does not utilize the full printing width of the relevant forme cylinder will be used. The information field can further display at which mounting position on the relevant forme cylinder, or at which storage position in the printing forme magazine which stores the printing forme, a non-printing printing forme, such as, for example, a so-called dummy plate, will be arranged. The information about the loading of the relevant forme cylinder, or the relevant storage positions of the printing forme magazine can preferably be provided graphically in the information field, for example, using at least one symbol. The information shown in the respective information field is taken, for example, from the data which is provided by the control unit of the production planning system. Alternatively or additionally, the information which is shown in the respective information field can result from a comparison of that data with the data which was collected during the manufacturing of the printing formes being prepared for the pending production run.

DESCRIPTION OF THE DRAWINGS

Preferred embodiments of the present invention are shown in the set of drawings, and will be specified in greater detail in what follows.

The drawings show.

DESCRIPTION OF PREFERRED EMBODIMENTS

Figure 1:
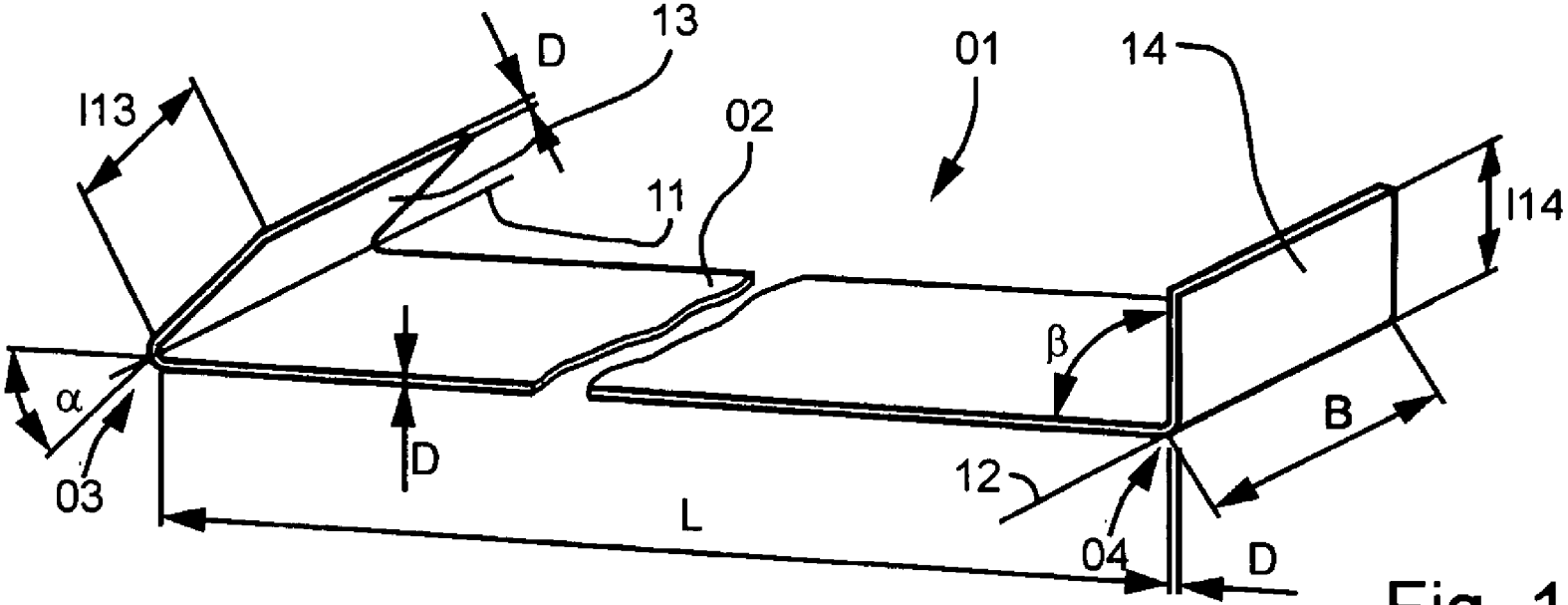
FIG. 1 a perspective illustration of a printing forme.
Figure 2:
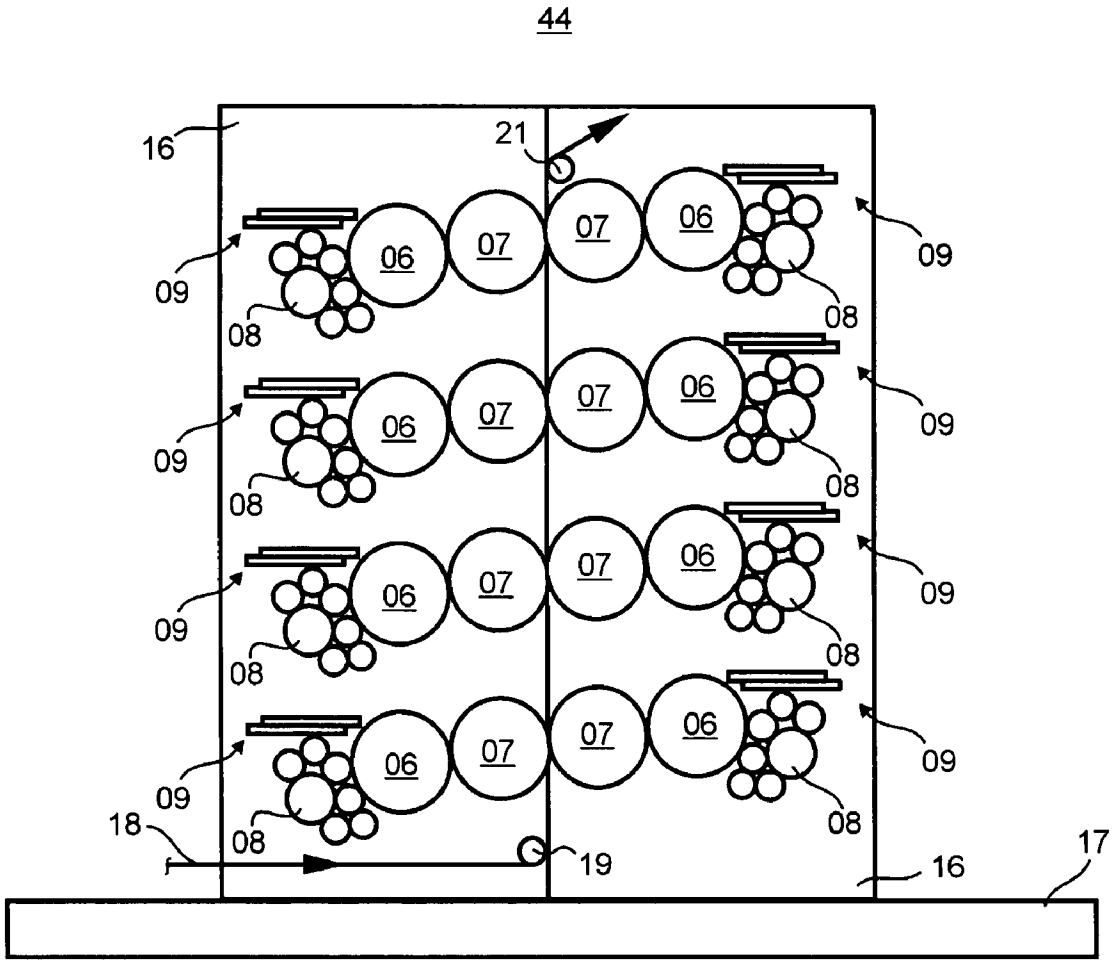
FIG. 2 a schematic side elevation view of a printing unit of a printing press with printing forme magazines.

Referring initially to FIG. 1, there is depicted a printing forme 01, which is embodied as being plate shaped, and which may be made of a metallic material. The printing forme 01, for example, has an essentially rectangular surface having a length L and a width B. The length L can measure between 400 mm and 1300 mm, for example, and the width B can measure between 280 mm and 1500 mm, for example. Preferred measurements for the length L lie between 360 mm and 600 mm, for example, and preferred measurements for the width B lie between 250 mm and 430 mm, for example. The surface has a contact side, identified in FIG. 1 as the contact surface 02, with which contact surface 02 the printing forme 01 rests, arranged on an outer surface of a forme cylinder 06, as shown in FIG. 2. The reverse side of the contact surface 02 is the working surface of the printing forme 01. This working surface is equipped with at least one print image, or at least it can be equipped with one print image. The printing forme 01 is preferably equipped with a bent suspension leg 13; 14 at each of two opposite ends 03; 04. The bending lines 11; 12 at which each of the suspension legs 13; 14 is bent form the boundaries of the contact surface 02. The suspension legs 13; 14 each extend preferably entirely, or at least partially, over the width B of the printing forme 01. The contact surface 02 of the printing forme 01 is flexible at least along its length L. When the printing forme 01 is arranged on the outer surface 07 of the forme cylinder 06, the printing forme can be curved to match the curvature of the forme cylinder. When the printing forme 01 is arranged on the outer surface 07 of the forme cylinder 06, the length L of the contact surface 02 therefore extends in the direction of the circumference of the forme cylinder 06, whereas the width B of the contact surface 02 extends in the axial direction of the forme cylinder 06. The printing forme 01 can be suitable for either a printing process that uses a dampening agent, such as, for example, a wet offset printing process, or for a so-called waterless printing process, such as, for example, a dry offset printing process.

One end 03 of the printing forme 01, as oriented in a production direction of the forme cylinder 06, is called its leading end 03. The opposite end 04 of the printing forme 01 is the trailing end 04 of the printing forme 01. At least the ends 03; 04 of the printing forme 01 on which the suspension legs 13; 14 are formed are made of a rigid material, such as, for example, a metallic material, for example, an aluminum alloy. Specifically, if the printing forme 01 will be used in a dry offset printing process, the printing forme 01 can also be made of plastic or even of rigid paper. A material thickness D in the area of the working surface of the printing forme 01, but at least the material thickness D of the suspension legs 13; 14, is usually a few tenths of a millimeter and, for example, is typically between 0.2 mm and 0.4 mm, and preferably is about 0.3 mm. Thus, the printing forme 01 is made entirely, or at least at its ends 03; 04, of a rigid material, and therefore the ends 03; 04 can be permanently reshaped by bending them against a material-specific resistance. Once at least the working surface of the printing forme 01 has been imaged with at least one print image, for example, in an exposure device, one bent suspension leg 13; 14 can preferably be produced, for example, in a bending unit, at least at one end 03; 04 of the printing forme 01, but preferably at both of its ends 03; 04, along the respective bending line 11; 12. The suspension leg or legs 13; 14, which have been produced in this manner, can be inserted into a narrow, slit-shaped opening in a groove in the forme cylinder 06, and can be fastened there by utilization of a securing device, such as, for example, a clamping device.

As depicted in FIG. 1, a suspension leg 13 may be bent at the end 03, relative to the length L, of the uncurved, flat contact surface 02 of the unmounted printing forme 01, at the bending line 11, about an opening angle $\alpha$. At the opposite end 04 of the forme 01, a suspension leg 14 is bent at the bending line 12 about an opening angle $\beta$, as seen in FIG. 1. The opening angles $\alpha$; $\beta$ generally lie between 30° and 140°. If the opening angle $\alpha$ is assigned to the leading end 03 of the printing forme 01, it is preferably embodied as an acute angle, and particularly measures 45°. The opening angle β at the trailing end 04 of the printing forme 01 is frequently preferably embodied as being greater than 80° or as an obtuse angle, especially as an angle measuring 85° or 135°. The bent suspension leg 13 at the leading end 03 has a length l13, which ranges from 4 mm to 30 mm, for example, and particularly ranges from 4 mm to 15 mm. The bent suspension leg 14 at the trailing end 04 has a length l14, which measures 4 mm to 30 mm, for example, and particularly ranges between 8 mm and 12 mm. The shorter length is preferable for ensuring the easiest possible removal of the suspension legs 13; 14 from the opening in the groove.

Multiple ones of such printing formes 01 are used, for example, in a multicolor offset printing press which operates using a wet offset printing process or a dry offset printing process. In one preferred embodiment, as seen in FIG. 2, at least one printing unit 44 in the printing press, which printing press preferably comprises multiple ones of such printing units 44, is equipped with printing forme magazines 09, as is depicted, by way of example, in FIG. 2. One printing forme magazine 09 is assigned to each forme cylinder 06. Each printing forme magazine 09 has, for example, at least as many storage positions as the number of printing forme mounting positions that are provided on the assigned forme cylinder 06. Each printing forme magazine 09 conveys, for example, in conjunction with a conveyor device, at least one printing forme 01, which has been stored in the relevant printing forme magazine 09, to one of the forme cylinders 06 of the printing unit 44. The printing unit 44, which is depicted schematically in FIG. 2, has a plurality of printing couples arranged in at least one frame 16 on a base 17. These printing couples are preferably arranged one above the other, in a bridge construction, or in a compact eight-couple construction, typically in a configuration having a low structural height, with eight print positions. Each printing couple also has at least one inking unit 08, in addition to its forme cylinder 06, and also has a transfer cylinder 07 which coordinates with each forme cylinder 06.

A print substrate 18, which is preferably a material web 18, and particularly is a paper web 18, is supplied continuously to the printing press during production. In the example depicted in FIG. 2, this material web 18 is conducted vertically through the printing couples. FIG. 2 shows four printing couples arranged in sequence in the direction of transport of the paper web 18, by way of example. The printing couples positioned to the right and to the left of the paper web 18 each comprise one of the transfer cylinders 07, each with one forme cylinder 06. The transfer cylinders 07, which are opposite one another at the paper web 18 in a printing couple, roll against one another. The paper web 18 is fed to the first printing couple, for example, via a first paper guide roller 19 which is arranged upstream of the first printing couple, and is drawn away from the fourth printing couple by the use of a second paper guide roller 21 that is arranged downstream of the fourth printing couple. At least one inking unit 08 is assigned to each forme cylinder 06. A printing forme magazine 09 is assigned to each forme cylinder 06. Each such printing forme magazine preferably has two chutes. Each such printing forme magazine 09, or at least its respective at least one storage position for at least one printing forme 01 to be stored therein, is preferably aligned, in its working position, essentially horizontally or, with only a slight inclination of less than 15° from the forme cylinder 06. In the operating position of each such printing forme magazine 09, at least one printing forme 01 can be exchanged between the chutes of its magazine and the forme cylinder 06. Either a printing forme 01, that is no longer required for executing a print order, is removed from the relevant forme cylinder 06 and is inserted into the respective chute, or a new printing forme 01, which is to be used for executing the print order, is removed from the relevant chute and is mounted on the forme cylinder 06. It is advantageous for the implementation, and particularly for the completion, of a printing forme change to be monitored by sensors. Likewise, the functions of the printing forme magazines 09, particularly with respect to a receipt or a delivery of at least one printing forme 01, in conjunction with the forme cylinders 06, can be controlled in such a way that a printing forme change can be selectively initiated, preferably from a control center 42 which is assigned to the printing press. Such a control center 42 is depicted schematically in FIG. 7. During an ongoing production run in the printing press, the printing forme magazines 09 can be prepared for an upcoming printing forme change. As a result, the set-up time for a subsequent new production run which set-up time requires down time for the printing couples, can be reduced to an extremely short period, such as, for example, a time of less than two minutes, and preferably a time of less than ninety seconds, for a complete change of all of the printing formes 01 of the printing couples that may be arranged in the printing unit 44. Depending upon the embodiment of the printing couples, ninety-six printing formes 01, for example, can be used simultaneously in the above-described printing unit 44. A rapid printing forme change of this type, even with a larger number of printing formes 01, increases the cost-effectiveness of the printing press due to its resultant extremely short down time.

For the purpose of identifying each of the respective printing formes 01, all of the formes are each equipped with coding. Such coding can preferably have an embodiment, in addition to that of a code that can be read by a person, for example, a coding involving a bar code. A bar code is a machine-readable printed code that is comprised of bars and spaces of various widths. The code can be applied by the use of a printing process, such as, for example, by an offset printing process, a flexographic printing process, an intaglio printing process, a laser printing process, a thermosetting printing process, or an inkjet printing process. The code is applied preferably on a non-printing area of the printing forme 01, such as, for example, on one of the suspension legs 13; 14. It is particularly advantageous to apply the code to the printing forme 01 in conjunction with the exposure of the working surface of the printing forme 01, because then no additional processing step is necessary. In this case, the coding is embodied and is arranged on a suspension leg 13; 14 of the printing forme 01, for example, before that suspension leg 13; 14 is formed in a bending process that is carried out in a bending unit 38, as depicted schematically in FIG. 7.

There are different types of barcodes. Although barcodes always contain a flat arrangement of symbols, they are differentiated as one-dimensional (1-D codes), two-dimensional (2-D codes), and three-dimensional (3-D codes) barcodes. In the latter three-dimensional codes, color forms the third dimension. Barcodes are most often standardized in terms of their graphic representation and their informational content, for example, in ISO/IEC 15415 (2-D codes), ISO/IEC 15416 (1-D codes), ISO/IEC 15418 (data structures) or ISO/IEC 15420. Known 1-D codes include, for example, the alphanumeric code 39 according to ISO/IEC 16388, code 128 according to ISO/IEC 15417, and the purely numeric code interleaved 2/5 according to ISO/IEC 16390. A 2-D code, which also encodes information perpendicular to its main direction, is a matrix code, for example, or is a data matrix code, for example, which is defined according to ISO/IEC 16022. Matrix codes can be read omnidirectionally using a camera system, such as, for example, by using a CCD camera. A Reed Solomon error correction doubles the data, whereby approximately 25% of the code can be destroyed without impairing decoding. Additional matrix codes include QR codes and Aztec codes, for example.

Figure 3:
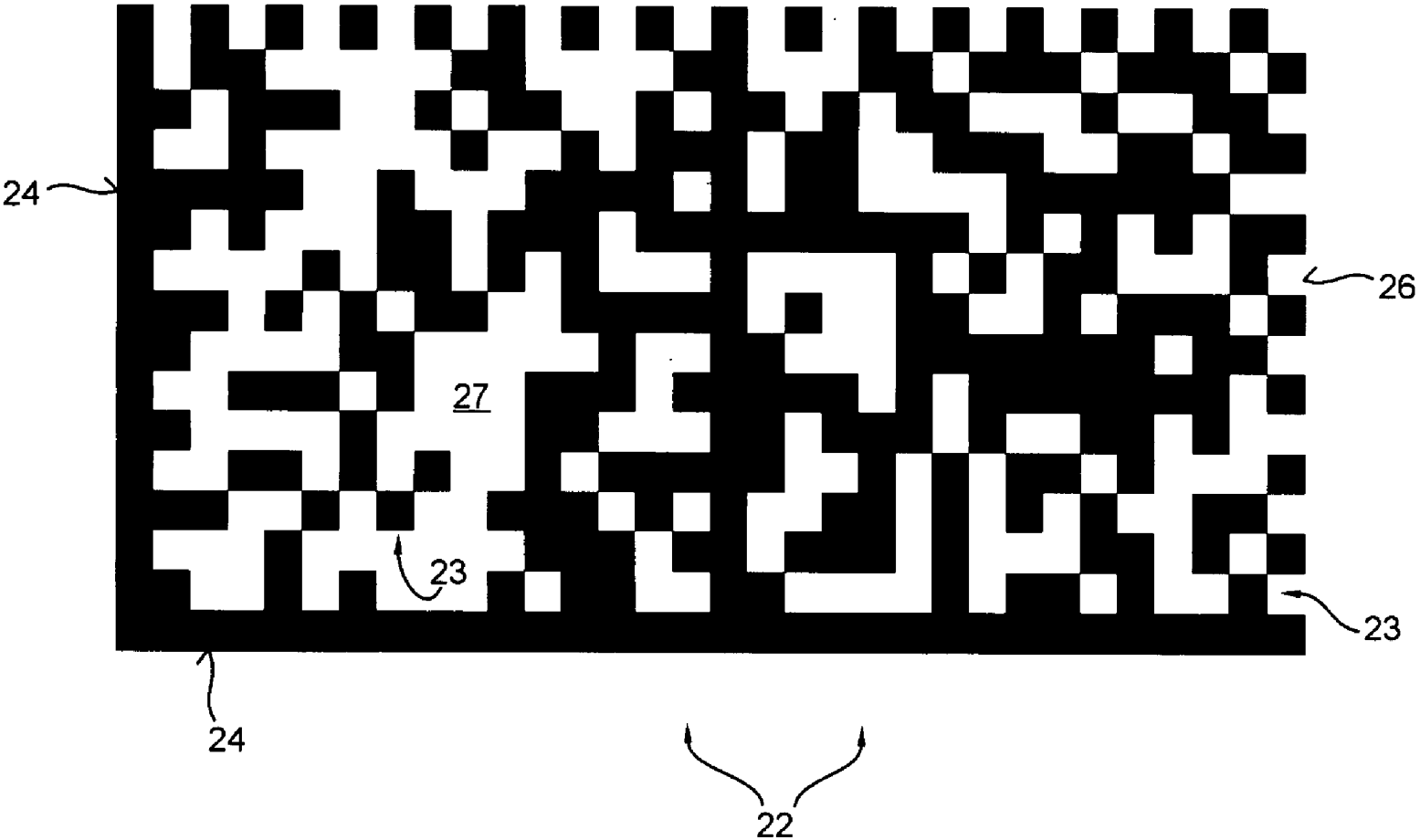
FIG. 3 a data matrix code.

Various versions of the data matrix code exist. For example, the data matrix code ECC 200, in which the letters ECC stand for the English "Error Checking and Correction Algorithm" and in which the number that follows these letters indicates a specific development stage of the data matrix code is generally well-known. The data matrix code consists of a rectangular area, the size of which is variable. This area contains square structural elements, each of which has a binary value. These square structural elements are embodied, for example, as being black or white. One example of a data matrix code is depicted in FIG. 3, in which two square data matrix code areas 22, each containing square structural elements 23, are arranged side by side, for example. For some applications, additional data matrix code areas 22 can be joined with one another to form the code. The data matrix code areas 22 can be arranged both side by side and above and/or below one another, such as, for example, in an arrangement comprising multiple rows and columns.

In the case of a 1-D code, different bar thicknesses must be clearly identified within a symbol plane. In contrast, in the data matrix code, it is important only to determine the value of each square structural element 23 shown in the symbol plane, for example, whether it is embodied as black or as white. A data matrix code also requires significantly less space than a 1-D code, while containing the same amount of information. For scanning a 2-D code, a camera system is always required, which camera system scans the information two-dimensionally, and evaluates the scanned image, for example, by the use of pattern recognition, for example, and by then comparing the detected coding pattern or marking pattern with a stored anticipated pattern. The camera system then converts the scanned structural elements 23 of the 2-D code to electronic, and preferably to digital, usable information. Because a camera system is used, 2-D codes must be illuminated on their surface by an illuminating device having at least one light source. The light that is reflected from the 2-D code is then imaged on an imaging plane of an image sensor, such as, for example, a CCD sensor or a CMOS sensor. The image sensor is a component of a line camera or of a surface camera, for example. In general, data matrix codes have few requirements in terms of color contrast and print quality. The light which is emitted by the light source of the illuminating device and the spectral sensitivity of the image sensor are matched to the optical properties of the printing forme 01 that bears the 2-D code, and particularly are matched to the reflective behavior and to the diffusive behavior of the printing forme 01. For scanning a 2-D code, which has been applied to a printing forme 01, by the exposure of that forme, a laser diode or a light-emitting diode that emits white, yellow, or green light has proven advantageous as the appropriate light source for the illuminating device. The light source can be integrated into a scanning device comprising an image sensor, for example. The scanning device is embodied particularly as a code reader 28, as is depicted schematically in FIG. 5. The code reader 28 is advantageously embodied as comprising a parameter adjustable automatic exposure device. The image sensor and the light source of the illuminating device are arranged, with respective operating directions, at an angle of inclination of at least 5° relative to a vertical line projecting from the symbol plane on the respective code area 22, and preferably are arranged at an angle of inclination ranging from 10° to 60°. For protection against ink mist and other contaminants, which may occur primarily in a printing couple, the code reader 28 should be mounted at a minimum distance a28 of 10 mm, for example, from the code area 22. The image sensor and the light source of the code reader 28 are protected against soiling, for example, by a mineral glass or by an acrylic glass pane.

The data matrix code comprises the following four main components, as shown in FIG. 3. A fixed boundary line 24 serves for pattern recognition and is used for calculating the rotational position of the data matrix code, thereby allowing any reading angle. An open boundary line 26, which is located opposite the fixed boundary line 24, and which forms a boundary that is not closed, is used for identifying the number of rows and columns, or the so-called matrix density. In the case of ECC 200, the element in the upper right corner is always white. The boundary lines 24; 26 delimit and encompass a memory area 27. The memory area 27 contains the actual binary information in encoded form. The amount of possible information is therefore also defined by the size and/or by the number of individual structural elements 23. An empty zone, which may be referred to as a quiet zone, surrounds the data matrix code. Such a quiet zone does not contain any information, and is not used for positional orientation. The quiet zone is one field or row in width, and is required for delimiting this particular code from other optical image elements.

The memory area 27 of the code contains information, for example, which can be used to distinguish printing formes 01 from one another for the purpose of their identification, and/or contains information that can be used to track the use of an individual, specific printing forme 01. Therefore, printing formes 01 that carry different print images and/or that belong to different color segments have codes that are different from one another. The code can contain an index which has been generated by a counter, for example, to allow the continuous counting of printing formes 01 used in sequence or to be used in sequence, and to allow identification of the sequence of such printing formes 01, and particularly printing formes that are of the same type and/or ones that are used in sequence at the same mounting position of a specific forme cylinder 06. The code can contain information about the respective mounting position of the particular printing forme 01 in the printing press.

An alternative to the embodiment of the code as a barcode consists in using a transponder system, and particularly using radio tags, which are referred to according to their English language abbreviation as RFID tags. Radio tags transmit their information in a contactless manner by the use of an electromagnetic field. Another alternative embodiment of the coding can consist of punched markings, such as, for example, punched holes.

Figure 4:
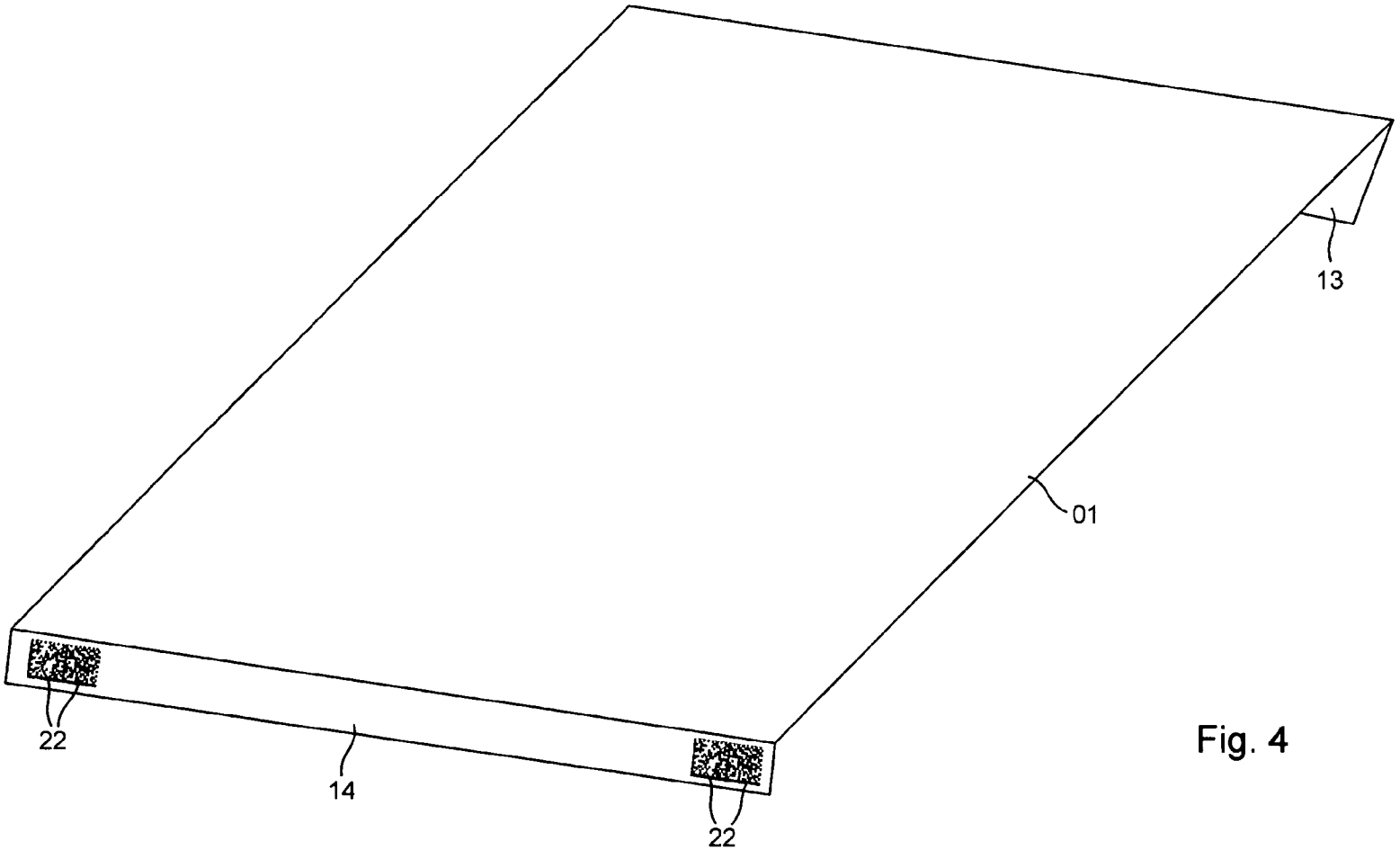
FIG. 4 a code applied to a printing forme.

FIG. 4 shows a printing forme 01, on the trailing suspension leg 14 of which printing forme 01 two codes are applied, which two codes are spaced from one another across the width B of the printing forme 01, as seen in FIG. 1. For example, two data matrix code areas 22 can be arranged in a row across the width B of the printing forme 01, each being situated in the side area of the suspension leg 14. Alternatively, or in addition to this arrangement of codes on the trailing suspension leg 14 of a printing forme 01, a code can also be applied to the center area of the suspension leg 14 of a printing forme 01, and particularly to the center area of a leg 14 of a printing forme 01 which is configured in panoramic format. Each data matrix code area 22 can contain only a certain amount of information. Depending upon the amount of information to be contained in the code, two or more data matrix code areas 22 may be required, and are preferably applied to the trailing suspension leg 14 of the printing forme 01.

Figure 5:
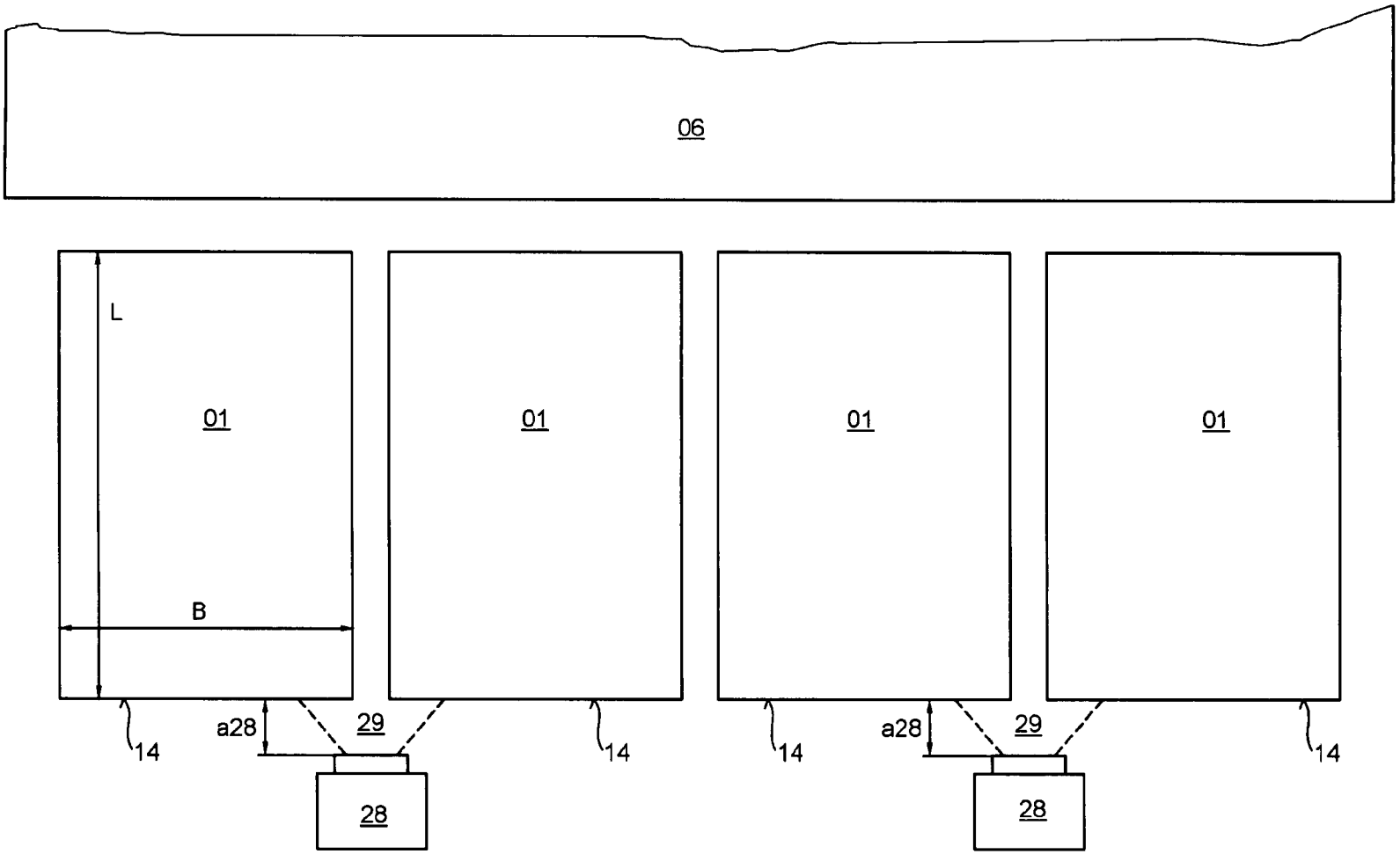
FIG. 5 a schematic top plan view of multiple printing formes arranged side by side, with code readers assigned to them in pairs.
Figure 6:
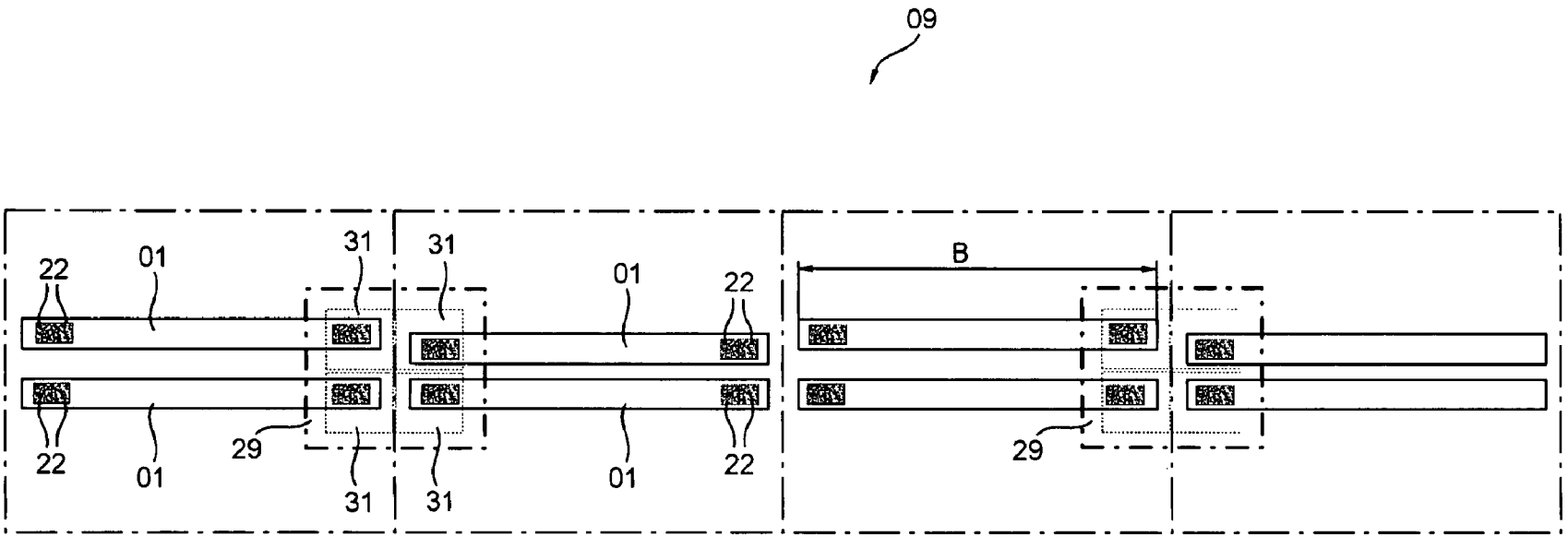
FIG. 6 a schematic end view of an arrangement of printing formes, each with at least one code applied to its respective trailing suspension leg.

A considerable cost savings can be realized by using only a single code reader 28 for multiple stored printing formes 01, which single code reader 28 scans, particularly simultaneously, the respective coding of printing formes 01 which may be stored in different storage positions. FIG. 5 and FIG. 6 provide an example of this implementation, with an arrangement of four printing formes 01, which may be, for example, arranged, or which are at least capable of being arranged, side by side on the outer surface of the forme cylinder 06, each such printing forme having a length L and a width B. Again as depicted in FIG. 1. A shared code reader 28 is assigned to every two adjacent printing formes 01. Each code reader 28 is embodied as or is incorporated into a camera system, for example. Each such camera system has as its image sensor, such as, for example, a CCD sensor. At least two printing formes 01 are preferably arranged in the scanning area 29 of each CCD sensor. The code reader 28 is therefore able to simultaneously scan all of the codes which may be located in its scanning area 29. The single image sensor thus simultaneously images all of the codes which can be scanned in the scanning area 29 of the code reader 28 at the same time and in the same image plane.

In the example shown in FIG. 5, each CCD sensor of each code reader 28 is directed toward the trailing suspension legs 14 of the printing formes 01 which may be arranged in its respective scanning area 29. The scanning area 29 of each such CCD sensor of each code reader 28 can be widened by the use of an optical device, for example, by a wide-angle lens, and preferably can have an obtuse opening angle, particularly across the width B of the printing formes 01. This will allow it to capture multiple codes, and particularly to capture the respective codes of multiple different printing formes 01, in the same scanning area 29, and to thereby scan them simultaneously. The CCD sensor of each respective camera system is arranged at a distance a28 from the trailing suspension leg 14 of the printing formes 01 which may be located in the respective scanning area 29 of each camera system. The distance a28 measures at least 10 mm, for example. The scanning area 29 of each image sensor is represented in FIG. 6 by a rectangular field, for example, which is depicted as being encompassed by a dotted-dashed line, in FIG. 6. This rectangular field always lies in the same plane as the data matrix code areas 22 which has been applied to the trailing suspension leg 14 of the printing formes 01. Such a field is also aligned parallel to the respective boundary lines 24; 26 of the data matrix code areas 22, for example.

FIG. 6 shows an arrangement of printing formes 01 which may be stored, for example, in one of the printing forme magazines 09 of the printing unit 44 which is depicted in FIG. 2. At least one code is applied to the trailing suspension leg 14 of each of these printing formes 01. In each case, the code is embodied, for example, in the form of two data matrix code areas 22 that are arranged in a row lengthwise across the width B of the respective printing forme 01, with each such matrix code area being arranged, for example, in the respective side area of the respective printing forme 01, as seen in FIG. 4. In FIG. 6, four chutes of a printing forme magazine, generally at 09, are indicated as being situated side by side, by way of example, and are assigned to a forme cylinder 06 that is to be loaded with printing formes 01 in its axial direction. Two such printing formes 01 are stored in the respective chutes, for example, specifically with one such printing forme 01 positioned in each of two storage positions which may be arranged one above the other. Code readers 28, each embodied as a camera system, are preferably arranged at the end surfaces of each chute that are opposite the forme cylinder 06. The respective scanning area 29 of each such image sensor belonging to one of the camera systems scans the respective codes of four printing formes 01, which are arranged adjacent to one another, together and at the same time, and specifically scans the codes of two such printing formes 01 which are arranged side by side, adjacent to one another in the axial direction of the forme cylinder 06, and which two printing formes 01 are situated in two different chutes. It also scans the codes of two printing formes 01 which are arranged one above the other in the same chute. The respective scanning area 29 of each image sensor belonging to one of the camera systems can have, for example, an angular cross-sectional area, particularly a rectangular cross-sectional area, and preferably can have a square cross-sectional area. The image sensor can have, for example, even a round, and preferably an elliptical or circular, cross-sectional area. All of the codes, which may be scanned in the scanning area 29 of the code reader 28, are imaged on the image plane of the image sensor of the code reader 28. The cross-sectional area of the scanning area 29 of the code reader 28 and the image plane of the image sensor are preferably arranged parallel to one another. As one embodiment, the image plane of the image sensor can be divided into multiple viewing zones 31, which can preferably be selectively activated by the respective camera system. Each code of one of the printing formes 01, which is scanned in the scanning area 29, is assigned to precisely one of the viewing zones 31 belonging to that scanning area 29. Each of the viewing zones 31 scans precisely one of the codes scanned by the scanning area 29, and therefore also images precisely one of the codes scanned by the scanning area 29 on the image plane of the image sensor. In the configuration depicted in FIG. 6, each of the printing formes 01 is preferably assigned to precisely one of the print positions on the forme cylinder 06. The forme cylinder 06 in this example can therefore be covered with a total of eight printing formes 01, specifically with four printing formes 01 in its axial direction and with two printing formes 01 in its circumferential direction. This configuration can easily be expanded to include two additional chutes arranged side by side for a 6/2 forme cylinder 06.

Figure 7:
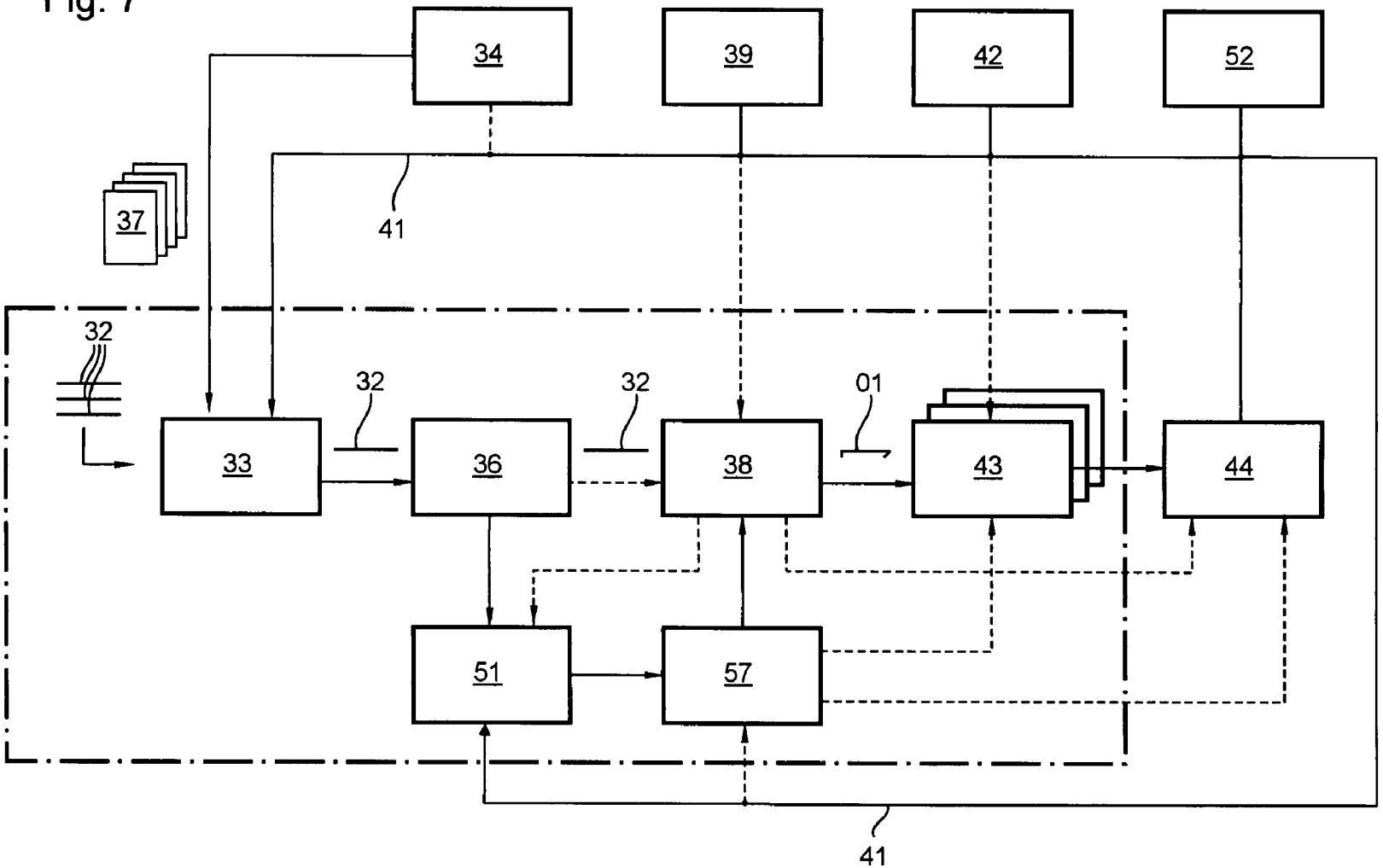
FIG. 7 a block diagram illustrating process steps for manufacturing printing formes.

As is indicated schematically in the block diagram which is shown in FIG. 7, for manufacturing the printing formes 01 to be used in a pending production run, flat, plate-type blanks 32 are individually exposed in a plate exposure device 33, which is spatially separate from the printing press. At least one print image is thus formed on each blank, using a corresponding master 37, which is provided to the plate exposure device 33, for example, by a computer 34 of a prepress stage, and preferably is provided electronically in the form of a file containing, for example, RIP data. The print image which is applied to the respective blank 32, in accordance with the respective master 37, is developed photochemically, for example, and therefore is fixed, forming it permanently. Such development is accomplished in a developing unit 36 that may be situated downstream of the plate exposure device 33, for example. In a subsequent process step in the manufacturing of printing formes 01 which are ready for use in the printing press, the relevant printing formes 01, each provided with at least one print image, are bent, preferably at two opposite ends 03; 04 for forming suspension legs 13; 14, as depicted in FIG. 1, in a bending unit 38, such as, for example, in an automatic bending machine, which, in addition to having at least one bending tool, preferably also has and can use at least one punching and/or cutting tool. To assist with alignment of each printing forme 01 in its proper position on the outer surface of the relevant forme cylinder 06, the relevant printing forme 01 can also be equipped, particularly prior to the bending of at least one of its suspension legs 13; 14, with at least one register punch or with a similar notch or clip on at least one of its edges. Once each respective printing forme 01 has been exposed, developed, bent and optionally punched and/or clipped, it is ready for use in a production run on the printing press.

The manufacturing of the printing formes 01, which will be associated with a specific production run, is preferably controlled on the basis of data, which are provided, for example, by a control unit 39 of a production planning system. The control unit 39 of the production planning system is connected, for example, by an electronic, cable-connected or wireless communications system 41, such as, for example, by a network for sharing electronic data, such as, for example, an Ethernet-based data network, to the plate exposure device 33 and preferably at least also to a control center 42 belonging to the printing press, for the purpose of sharing data. In the preferred embodiment, the computer 34 of the prepress stage and the control unit 39 of the production planning system can provide their respective data to the plate exposure device 33 using the same communications system 41, which is indicated in FIG. 7, as an alternative to the separate connection between the computer 34 of the prepress stage and the plate exposure device 33, by a dashed line connecting the computer 34 of the prepress stage to the communications system 41. Likewise, the bending unit 38, and more specifically a control unit belonging to the bearing unit and controlling its functions, is also preferably connected to the communications system 41, allowing it to optionally receive control data, especially such control data which is provided by the control unit 39 of the production planning system, and/or to share such data with the control unit 39 of the production planning system.

The printing formes 01 that have been prepared, that are ready for use and which may be required for a specific production run are supplied to a printing unit 44, shown schematically in FIG. 2, of the printing press, for example, in one of several available mobile collection containers 43. These collection containers 43 can be moved automatically, for example, and are, for example, a component of a driverless transport system. In each of these respective collection containers 43, the printing formes 01, which may be required at a specific location of use in the printing press, such as, for example on a specific forme cylinder 06, are preferably stored as a set, such as, for example, as a self-contained unit of integral printing formes 01, which are to be transported together to the relevant forme cylinder 06. The printing formes 01, which may be transported manually or, for example, may be transported in the respective collection container 43 to the relevant location of use, and particularly which are transported to the forme cylinder 06, are arranged on the relevant forme cylinder 01, in their respective mounting positions on the relevant forme cylinder 06, for example, either manually by an operator or preferably automatically by the use of a conveyor device, which can be controlled from the control center 42, for example, and which is particularly embodied as being connected to a printing forme magazine 09.

Figure 8:
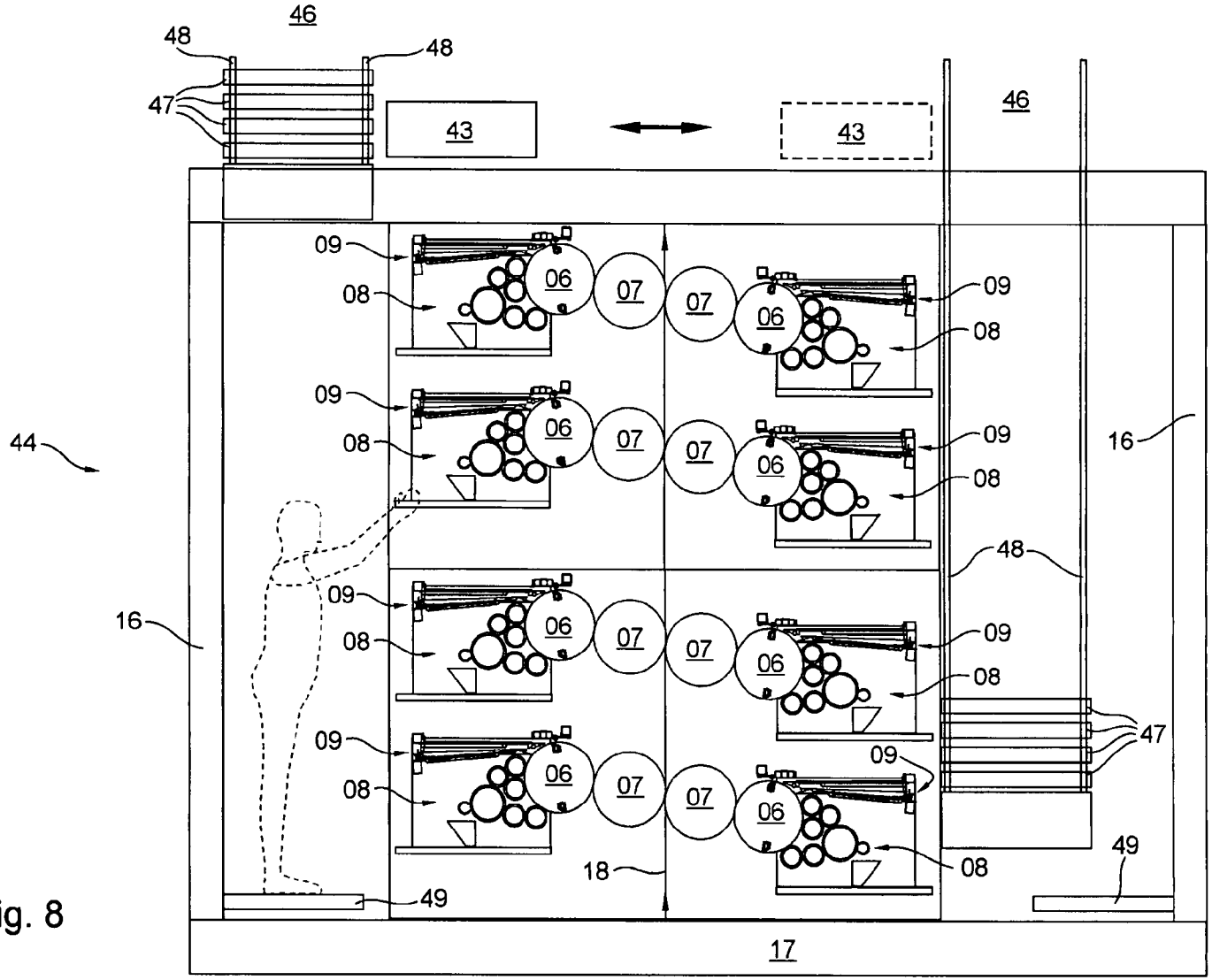
FIG. 8 a schematic side elevation view of a further development of the printing unit of FIG. 2.

FIG. 8 schematically depicts a similar printing unit 44 to the unit shown in FIG. 2. All of the corresponding components and elements in FIGS. 4 and 8 are identified by the same reference signs. The printing unit 44 shown in FIG. 8 represents a further development of the present invention, in that a separate handling device 46 is preferably arranged on each of the two operating sides of the printing unit 44. Each handling device preferably comprises a plurality of platforms 47, each platform 47 being arranged on at least one guide element 48. Through the use of such platforms 47, ready-to-use printing formes 01 can be transported to the relevant printing forme magazines 09. The relevant printing formes 01 are conveyed automatically by each respective platform 47 to the associated storage position of the respective printing forme magazine 09. The platforms 47 of the handling device 46 are each embodied, for example, as a lifting device, which executes a vertical movement on the associated operating side of the printing unit 44. The ready-to-use printing formes 01, which have been transported by the mobile collection container 43 to the associated printing unit 44, are preferably automatically received by the platforms 47 of the handling device 46 and are then transported to the relevant printing forme magazine 09. In FIG. 8, a double arrow indicates that each mobile collection container 43 transports a set of ready-to-use printing formes 01 to either one of the operating sides of the relevant printing unit 44. The printing unit 44, which is shown in FIG. 8, is therefore expanded, over the printing unit 44 shown in FIG. 2, to include a conveyor device. Such a conveyor device comprises, for example, a distribution system comprising a handling device 46, and a loading system for loading the printing forme magazines 09 with ready-to-use printing formes 01. The printing unit 44 preferably has a walkway 49, the height of which can preferably be adjusted by the provision of a controllable drive, on each of its two operating sides. Each such walkway 49 facilitates access by press operators to the respective printing couples of the printing unit 44.

As was described above, the device which is necessary for manufacturing the ready-to-use printing formes 01 has at least one plate exposure device 33, and generally also has at least one developing unit 36 and at least one bending unit 38. In practice, however, printing formes 01 belonging to the same set are frequently not manufactured in a gapless sequence, one immediately in front of the other. Instead, such printing formes 01 are particularly exposed in a more random sequence in the plate exposure device 33, based upon a different editorial completion of the content of the print images to be printed. After their respective exposure, the printing formes 01 must be grouped into sets that are required at the respective locations of use in the printing press, in order to avoid unnecessary transport paths between the device for manufacturing printing formes 01 ready for use in the printing press and the respective location of use in the printing press. Accordingly, the device, that is usable for manufacturing printing formes 01 which are ready for use in a printing press, is expanded to include at least one storage device 51, as seen in FIG. 7. In such a storage device 51, printing formes 01 that have been provided with at least one print image are intermediately stored until a complete, integral set of printing formes 01 has been manufactured, for the combined transport thereof to a specific forme cylinder 06 or to a printing forme magazine 09 that is arranged in the printing unit 44. The storage device 51 thus performs the function of a buffer in the production line for manufacturing printing formes 01 that are ready for use in a printing press. A check for completeness of a specific set of printing formes 01 is carried out, for example, by, or at least in connection with the storage device 51, for example, on the basis of the data provided to it by the control unit 39 of the production planning system. The storage device 51 has a control unit, which is preferably also connected to the communications system 41, thus allowing it to communicate particularly with the control unit 39 of the production planning system and/or with the control center 42 of the printing press. Such communication can relate to a sharing or to an exchange of control data, or to information about the number and type of printing formes 01 which are intermediately stored in the storage device 51.

The storage device 51 is preferably arranged downstream of the developing unit 36 and upstream of the bending unit 38 in the production flow, which production flow is represented, by way of example, in FIG. 7 by a solid arrow line, or in other words, is located in the production line for manufacturing the printing formes 01. The flat printing formes 01, that have not yet been bent, can be stored in less space, and the risk of mutual damage caused, for example, by a suspension leg 13; 14 scratching a print image, for example, is prevented. The dashed arrow lines in FIG. 7 indicate alternative transport paths within the device for manufacturing printing formes 01 that are ready for use in the printing press, and particularly show an arrangement of the storage device 51 situated downstream of the bending unit 38 in the production line.

The storage device 51 is preferably embodied such that in it, printing formes 01 can be placed in storage and can also be removed from storage at the same time. The storage device 51 has at least as many storage spaces as the number of printing formes 01 belonging to an integral set of printing formes 01. The number of printing formes 01 belonging to such an integral set need not be identical to the maximum number of mounting positions on the forme cylinder 06 involved in the pending production run, or to the maximum number of storage positions in the relevant printing forme magazine 09, for which the printing formes 01 to be transported are intended. Instead, the relevant set of printing formes 01 comprises the number of printing formes 01 that are to be mounted and/or that are to be exchanged, in the same operating process, on the forme cylinder 06 involved in the pending production run or in the relevant printing forme magazine 09. The storage device 51 is preferably equipped with enough storage spaces to accommodate multiple sets of printing formes 01, such as, for example, all of the sets of printing formes 01 that can be used in the relevant printing unit 44.

The storage device 51 has at least one first handling device, with which printing formes 01 that have been supplied to the storage device 51 are stored in appropriate storage spaces in that storage device 51. One of the printing formes 01 is preferably assigned to each of the storage spaces. At least one additional second handling device, which is different from the first, can be provided for removal of the plates from the storage spaces in the storage device 51. This second handling device takes up or grasps a printing forme 01 that has been stored in one of the storage spaces and removes it from storage, when the set of printing formes 01, to which the relevant printing forme 01 belongs, is called up for transport to the printing unit 44. The first handling device and/or the second handling device executes a movement relative to the stationary storage spaces of the storage device 51, in the same plane, for example, and in two directions, which preferably are orthogonal to one another. Alternatively, each handling device for placing at least one of the printing formes 01 in storage or for removing that forme from storage is stationary relative to the storage device 51, and a magazine comprising the respective storage spaces of said storage device 51 moves translationally and/or rotationally relative to the at least one handling device or relative to the multiple handling devices, and particularly wherein there are two such handling devices. The processes for placing printing formes 01 in storage and/or for removing those printing formes from storage each involve a relative movement between the storage spaces of the storage device 51 and at least one device which executes the respective placement in, or the removal of each printing forme 01 from storage, for example, the handling device.

The device for manufacturing printing formes 01 that are ready for use in a printing press thus comprises at least one plate exposure device 33. At least one storage device 51 is provided in the device and is positioned downstream of that plate exposure device 33. The storage device 51 intermediately stores at least one integral set of printing formes 01, which are associated with respect to a shared location of use in terms of a specific forme cylinder 06 or a specific printing forme magazine 09, before those associated formes are preferably transported together to the printing press. The location of use of the printing formes 01, which are to be transported to their ultimate location of use, as a set, therefore consists of one of multiple forme cylinders 06 or of printing forme magazines 09 which are located in the printing press.

Printing formes 01, which are stored in the storage device 51 and which belong to different sets, are preferably each removed from storage as an integral set of printing formes 01 in an uninterrupted sequence, regardless of whether such printing formes 01 have been presorted beforehand into integral sets of printing formes 01 in the storage device 51, or have been intermediately stored in storage spaces in the storage device 51 in a random, or chaotic order. If the storage device 51 does not remove its stored printing formes 01 from storage in sets, a sorting station 57, for use in sorting printing formes 01, is provided in connection with the storage device 51. Such a sorting station 57 may be located, for example, downstream of a delivery of the printing formes 01 from the storage device 51. The sorting device 57 sorts the printing formes 01 into integral sets of printing formes 01 that are required in the respective printing unit 44. The formes being sorted are typically associated on the basis of their shared location of use in terms of a specific forme cylinder 06 or for use in a specific printing forme magazine 09. In a first embodiment, the sorting station 57 can be embodied as being integrated into the storage device 51, and in another embodiment, it can be embodied as an independent device, separate from the storage device 51. The sorting station 57 may be arranged between the developing unit 36, and thus upstream of the bending unit 38 in the production line for the printing formes 01, and one of the mobile collection containers 43. As an alternative, the sorting station 57 can also be arranged downstream of the bending unit 38 in the production line, as represented in FIG. 7 by dashed directional lines, so that in, or by use of the sorting station 57, printing formes 01 that have already been bent are sorted into sets ready for use, and, for example, are then delivered to one of the plurality of mobile collection containers 43. This can be done unless the individual printing formes 01 will be transported manually to the respective location of use in the printing unit 44. The sorting station 57, and specifically a control unit that belongs to that sorting station and which controls its functions, is preferably also connected to the communications system 41, to which communication system 41 additional control units 33; 34; 38; 39; 42; 51 are already connected, as is depicted schematically in FIG. 7.

FIG. 7 schematically depicts a plurality of alternatingly or optionally usable mobile collection containers 43, for example, three such collection containers 43, each of which preferably automatically transports a set of printing formes 01 to its respective location of use in the printing unit 44. In addition, or as an alternative to this group transport of printing formes 01, dashed arrow lines in FIG. 7 indicate transport paths leading away from the device for manufacturing printing formes 01 ready for use to the printing press, with each of those transport paths extending past the mobile collection containers 43, and thus each indicating a manual transport of individual printing formes 01 to the relevant printing unit 44.

In the preferred embodiment of the present invention, the collection containers 43, which transport the at least one printing forme 01, provide data to the communications system 41, regarding at least the position that is currently occupied by the relevant printing forme 01 on its transport path to the printing press, or in other words, information regarding its respective current location.

Within the apparatus, which is indicated in FIG. 7 by a dotted-dashed boundary line, and which serves to provide at least one printing forme 01 ready for use in the printing unit 44, the printing forme that has been exposed with at least one print image is intermediately stored in the storage device 51 prior to its transport to the printing unit 44. The printing forme 01, that has been exposed with the at least one print image, is equipped with at least one register punch prior to its intermediate storage in the storage device 51. Alternatively, at least one notch or clip is produced on at least one of the edges of this printing forme. On this printing forme 01, and only after its intermediate storage in the storage device 51, at least one bent suspension leg 13; 14 is formed. The at least one print image of the printing forme 01 is produced in the plate exposure device 33 and is fixed in a developing unit 36, all as has been described above. The register punch and/or the at least one notch or clip on one of the edges of the printing forme 01 and/or the formation of at least one bent suspension leg 13; 14 on that printing forme 01 are each preferably executed in the bending unit 38. Advantageously, at least two of the tasks which are to be performed in the bending unit 38 and specifically the register punching and/or the at least one notching or clipping on one of the edges of the printing forme 01 and/or the formation of at least one bent suspension leg 13; 14 on the printing forme 01 are carried out in the same bending unit 38. Before execution of at least one of the register punching and/or the at least one notching or clipping on one of the edges of the printing forme and/or the bending of at least one suspension leg 13; 14 in the bending unit 38, the printing forme 01 is aligned, for example, using an imaging system, and particularly using a video system which may be directed toward the exposed printing forme 01. Additionally or alternatively, the printing forme 01 can be aligned, at least before the bending of at least one suspension leg 13; 14 in the bending unit 38 is carried out, by using the register punch and/or the at least one notch or clip which has been formed on one of its edges. In the plate storage device 51, a plurality of printing formes 01 are preferably intermediately stored, particularly in groups which have been pre-sorted according to their respective location of use. The printing formes 01 stored, which are intermediately in the storage device 51, are delivered sequentially, for example, to the bending unit 38.

The sorting station 57 and the storage device 51 group printing formes 01 that have been supplied to them automatically, for example, on the basis of the coding which preferably has been applied to each of those printing formes 01, into integral sets, which are, in turn, to be supplied, in the same operating process, to the relevant forme cylinder 06 or to the relevant printing forme magazine 09, particularly by using one of the mobile collection containers 43. This coding is embodied, for example, as a data matrix code 22. Such a code is preferably applied to the non-printing area of the relevant printing forme 01, such as, for example, on a suspension leg 13; 14 which, at the time the particular printing forme 01 was placed in storage in the storage device 51, had not yet been bent, as is depicted in FIG. 3, and also in FIG. 4.

To allow the visualization, and the like, of preferably both the particularly sequential process of manufacturing printing formes 01, which will be ready for use in the printing press, and the operational status at the location of use of those printing formes 01, a display device 52 with an optical display, for example, and particularly a display device using a graphic display, and which preferably uses at least one symbol, is preferably provided. Such a display device 52 is preferably connected to the device for carrying out the disclosed process, as is indicated in FIG. 7, for example, by the dotted-dashed outline. The display device 52 displays, in an overall depiction which is simultaneously capable of showing multiple mounting positions on a forme cylinder 06 having the multiple mounting positions, or which is simultaneously capable of showing multiple storage positions of a printing forme magazine 09 having the multiple storage positions, at which of these multiple mounting positions on the relevant forme cylinder 06 or at which of these multiple storage positions in the printing forme magazine 09, a printing forme 01 is to be arranged. The display device 52 thus has a preferably electronic display, which may be embodied as a monitor or as a screen mask, for example, and which displays at least a use of a printing forme 01 at its location of use in a printing press. At the location of use of the printing forme 01 in the printing press, a plurality of different positions are provided. Each such position at the location of use relates to one of multiple mounting positions on a forme cylinder 06 having the multiple mounting positions or to one of the multiple storage positions of a printing forme magazine 09 having the multiple storage positions. The display of the display device 52 displays a plurality of different locations of use in the printing press at the same time. The display device also displays at which of the positions of a specific location of use, and having multiple such positions, each for receipt of one printing forme 01 to be arranged there, a printing forme 01 is to be arranged. This display provides a printing press operator with an overview of, and control over the status of a process of resetting the printing press for a new production run. The display device 52 can be embodied as an integral component of the control center 42 of the printing press, or as being connected to at least one other machine unit of the printing press, such as, for example, to a printing unit. The information that is to be displayed by the display device 52 can then be displayed, for example, on a monitor of the control center 42 or on a monitor of the other machine unit.

The display device 52 can also show, on its display, different states and/or properties relating to at least one of the printing formes 01 that has been manufactured or at least that will be manufactured. In other words, the display device can also show, for example, to which mounting position on the relevant forme cylinder 06 or to which storage position in the printing forme magazine 09 an already manufactured, and thus a ready-to-use printing forme 01 is assigned. The display device can also depict to which mounting position on the relevant forme cylinder 06, or to which storage position in the printing forme magazine 09 a printing forme 01 which is in the manufacturing process, and which is thus in the supply line, is assigned. Further, the display device can show at which mounting position on the relevant forme cylinder 06, or at which storage position in the printing forme magazine 09 any printing forme will be arranged for the pending production run. In addition, the display device can illustrate which mounting position on the relevant forme cylinder 06, or which storage position in the printing forme magazine 09, will not be covered with a printing forme 01 in the pending production run, because, for example, in the pending production run a print substrate 18 having a print substrate width that does not utilize the full printing width of the relevant forme cylinder 06 will be used. Finally, the display unit or device can also depict at which mounting position on the relevant forme cylinder 06, or at which storage position in the printing forme magazine 09, a non-printing printing forme 01, such as, for example, a so-called dummy plate will be arranged.

The display device 52 can take the information which will be necessary for the formation of the respective display, for example, from the data which is provided by the control unit 39 of the production planning system, preferably comparing that data with the data that are collected during the manufacturing of the printing formes 01 which have been prepared for the pending production run. As is shown in FIG. 7, it is therefore advantageous for the display device 52 to be connected to the communications system 41, to which the plate exposure device 33, the computer 34 of the prepress stage, the control unit 39 of the production planning system, the storage unit 51 and optionally the bending unit 38, and the control center 42 belonging to the printing press are also connected, for example, and to enable a preferably mutual sharing of data by use of the network which is produced in this manner.

If the display device 52 is embodied as being an independent device, it is spatially arranged, for example, in the area of the location where the mobile collection container 43 receives the printing formes 01 relating to a specific forme cylinder 06 or to a specific printing forme magazine 09, for example, and before those formes are transported to the relevant forme cylinder 06 or to the relevant printing forme magazine 09. Regardless of whether it is to be embodied as an independent device, as an integral component of the control center 42 or as a component of another machine unit of the printing press, the display device 52 can also be used to display the current status of the printing formes 01 which are to be produced for a specific production run. The display device 52 is thus usable to display whether a specific printing forme 01 is currently located, for example, in the plate exposure device 33, in the developing unit 36, in the bending unit 38 or in the storage device 51. Therefore, the display of the display device 52 particularly indicates to an operator of the printing press whether or not a set of printing formes 01 which may be required for a specific forme cylinder 06 or for a specific printing forme magazine 09 is already complete. The display device 52 can also display for which printing unit 44, which printing unit preferably comprises multiple forme cylinders 06 and/or printing forme magazines 09, and which printing unit 44 is located in a complex printing system, such as, for example, one comprising multiple printing units 44, at least one set of printing formes 01 is already complete. The display device 52 can further display which of the multiple sets of printing formes 01, that are to be arranged in a specific one of the printing units 44, is already manufactured and ready for use.

Figure 9:
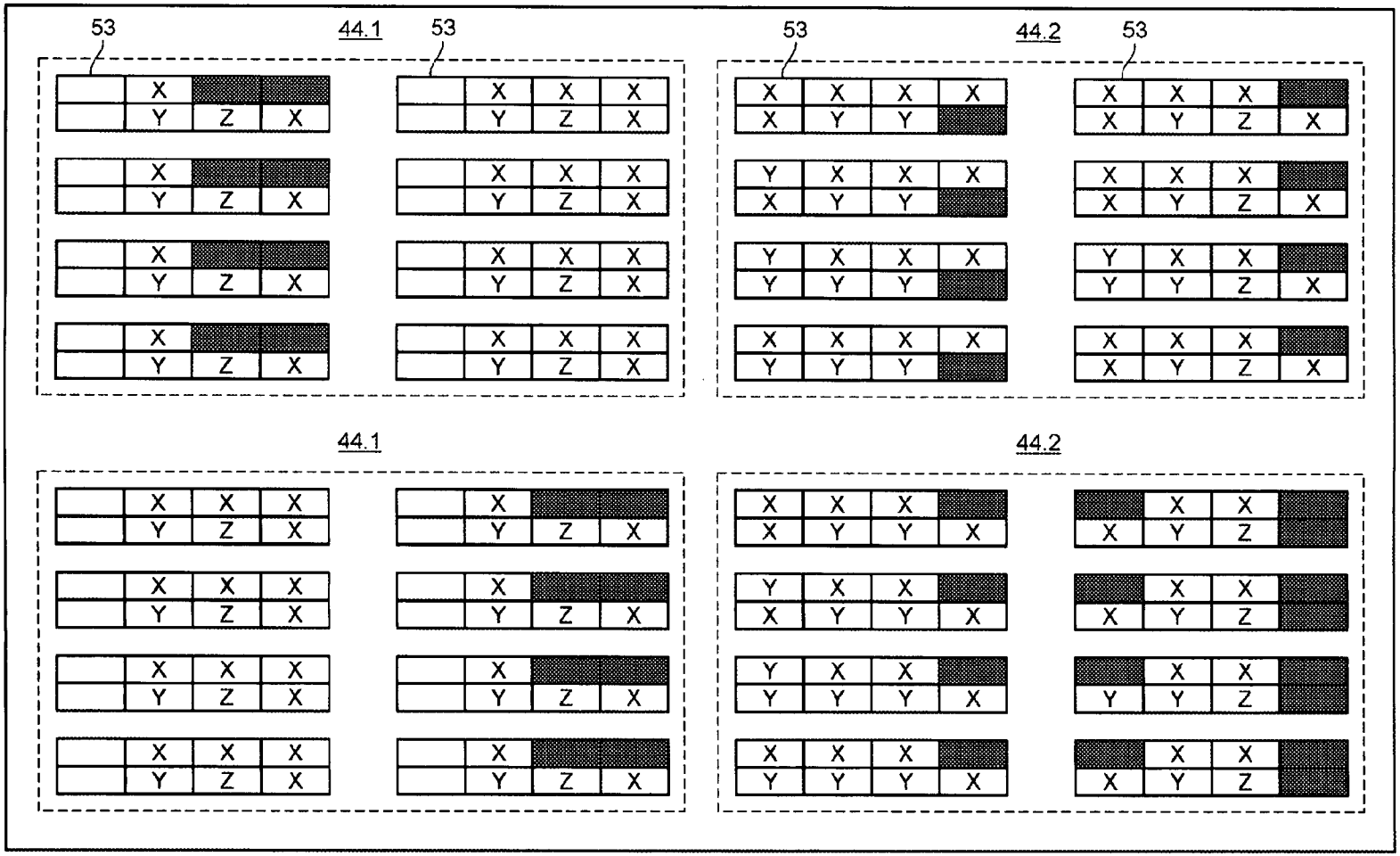
FIG. 9 a display of a display device.

FIG. 9 shows, by way of example, the display of the display device 52 for a printing system comprising at least two printing units 44.1; 44.2, which at least two printing units 44.1; 44.2, for example, in conjunction with additional units, which are not shown here, and which may be, for example, a folding unit, form a section of a printing press. The illustration in the upper half of FIG. 9 relates to a first production run and the illustration in the lower half of FIG. 9 relates to a second production run, which is different from the first production run. For each of the two printing units 44.1; 44.2, the respective locations of use for the manufactured, ready-to-use printing formes 01 are displayed in FIG. 9 in two blocks, arranged in rows, for the two production runs. The location of use for each of these printing formes 01 is on one of multiple forme cylinders 06 or in one of the printing forme magazines 09 arranged in the printing press. In each block, the locations of use for these printing formes 01, and located at the respective operating sides of the respective printing units 44.1; 44.2, are shown in two parallel columns. Each of these blocks, which is assigned to one of the two printing units 44.1; 44.2, is indicated, in FIG. 9, by a dashed outline. At each operating side of the respective printing unit 44.1; 44.2, four locations of use for four different sets of printing formes 01 are provided, one above the other vertically, for example, and corresponding to the arrangement of the printing couples in the relevant printing unit 44.1; 44.2, as seen in FIG. 2 and in FIG. 8. Each location of use has, for example, four mounting positions or four storage positions, each for one printing forme 01 of the relevant set of printing formes 01, and arranged side by side in the axial direction of the relevant forme cylinder 06. Two mounting positions or two storage positions, for example, each for one printing forme 01 of the relevant set of printing formes 01, are provided, one in front of the other in the circumferential direction of each relevant forme cylinder 06. For each location of use for a set of printing formes 01, an information field 53 is provided in the display of the display device 52. That information field 53, in the example illustrated in FIG. 9, consists of four positions arranged side by side and of two positions arranged one on top of the other for printing formes 01 of the relevant set. Each of the two printing units 44.1; 44.2 is therefore assigned a total of eight information fields 53, which information fields 53 display the status of a printing forme 01 which is to be manufactured and/or display the status of the loading of a mounting position or a storage position, in each of eight different positions. The display of the display device 52 is therefore capable of simultaneously displaying multiple different production runs to be executed, in sequence, in the same printing press, with multiple locations of use, each assigned to those production runs, for the printing formes 01 which may be required for the respective production runs.

On the basis of a code, various pieces of information can be displayed on the display of the display device 52. In each information field 53, a specific piece of information relating to the status of a printing forme 01 and/or to the status of the loading of a mounting position or of a storage position may be taken from each position. A position that is left blank, as is indicated in FIG. 9 by a white field, can indicate, for example, that for the pending production run, no printing forme 01 is required at that position in the relevant printing unit 44.1; 44.2. A position that is filled in can mean that a printing forme 01 is already located in that position at the relevant location of use, because, for example, the printing forme 01 already in that position can be carried over from a preceding production run. Positions which are marked by a symbol, for example, by an "X," can indicate, for example, that for each of these positions a printing forme 01 has yet to be manufactured. Positions marked with another symbol, for example by a "Y," can indicate, for example, that for each such position a printing forme 01 that has already at least been exposed is located in the storage device 33. Positions marked with a further symbol, for example, a "Z," can indicate, for example, that at the relevant position, an unexposed printing forme 01, such as, for example, a dummy plate, will be used. Those printing formes 01 that will be used in the planned next production run in the relevant printing units 44.1; 44.2, in those positions marked with a symbol, for example, with an "X," "Y," or "Z," make up the integral set of printing formes 01 which are to be transported to the respective location of use. The display of the display device 52 therefore provides, in an overall display which displays multiple positions, such as, for example, mounting positions or storage positions, simultaneously, not only information regarding at which of these positions a printing forme 01 will be arranged, but also for which of these positions a printing forme 01 has yet to be manufactured and/or will be transported to its respective location of use along with additional printing formes 01 that are required at the same location of use.

To further assist in the proper arrangement of printing formes 01, which may be involved in a pending production run, for example, in positions relating to either mounting positions on a forme cylinder 06 having multiple mounting positions or to storage positions in a printing forme magazine 09 having multiple storage positions, for example, an information field 54, corresponding, for example, to an information field 53 in the display of the display device 52, can also be provided on at least one, for example, but preferably on multiple, and particularly on each of the printing formes 01 that are to be arranged on the relevant forme cylinder 06 or in the relevant printing forme magazine 09. Such an information field 54, as depicted schematically in FIG. 10, contains information at least about the arrangement of an additional printing forme 01 and/or about an operating procedure relating to that additional printing forme 01, the position of which is adjacent to the printing forme 01 containing the information field 54. That information field 54 therefore provides assistance in the use, and particularly in the arrangement, of a printing forme 01 on one of multiple positions of a component belonging to a printing couple of a printing unit 44; 44.1; 44.2 or printing press. That component can be embodied, for example, as a forme cylinder 06 or as a printing forme magazine 09.

Thus the information field 54, which may be applied, for example, by the plate exposure device 33, preferably in a non-printing area, and particularly on the suspension leg 13; 14, of the relevant printing forme 01, can display various information. It can display, for example, at which mounting position on the relevant forme cylinder 06 or at which storage position in the printing forme magazine 09 the printing forme 01 containing the information field 54 is to be arranged. It can also display at which other mounting position on the relevant forme cylinder 06, or at which other storage position in the printing forme magazine 09 for storing that printing forme 01, another printing forme 01, that has yet to be manufactured, is to be arranged. The information field 54 can further display at which mounting position on the relevant forme cylinder 06, or in which storage position in the printing forme magazine 09 for storing that printing forme 01, no new printing forme 01 will be applied currently, such as, for the pending production run, and instead that the printing forme 01, which is already in place from a preceding production run, will be left in place. Information field 54 can also display which mounting position on the relevant forme cylinder 06, or which storage position in the printing forme magazine 09 for storing the printing forme 01, will not be loaded with any printing forme 01 during the pending production run, because in the pending production run, for example, a print substrate 18 will be used, which has a print substrate width which does not utilize the full printing width of the relevant forme cylinder 06. In addition, the information field 54 can display at which mounting position on the relevant forme cylinder 06, or at which storage position in the printing forme magazine 09 for storing the printing forme 01, a non-printing printing forme 01, such as, for example, a so-called dummy plate, will be arranged. Therefore, the information field 54 can contain information about an arrangement and/or about an operating procedure relating to multiple, or preferably relating to all of the positions relating to the same component.

The information about the arrangement of printing formes 01 involved in a pending production run in the relevant positions can preferably be provided in the information field 54 graphically, for example, using at least one symbol, or can be provided in plain text. The information which is shown in the respective information field 54 is taken, for example, from the data that is provided by the control unit 39 of the production planning system. Alternatively or additionally, the information shown in the respective information field 54 can result from a comparison of the former data with the data which was collected during the manufacturing of the printing formes 01 that have been prepared for the pending production run. Each information field 54 applied to the printing forme 01 can be applied along with, and in addition to, a data matrix code, for example, on the suspension leg 13; 14 of the relevant printing forme 01. The information field 54 can preferably be read directly by press operating personnel, and others, without technical assistance.

Figure 10:
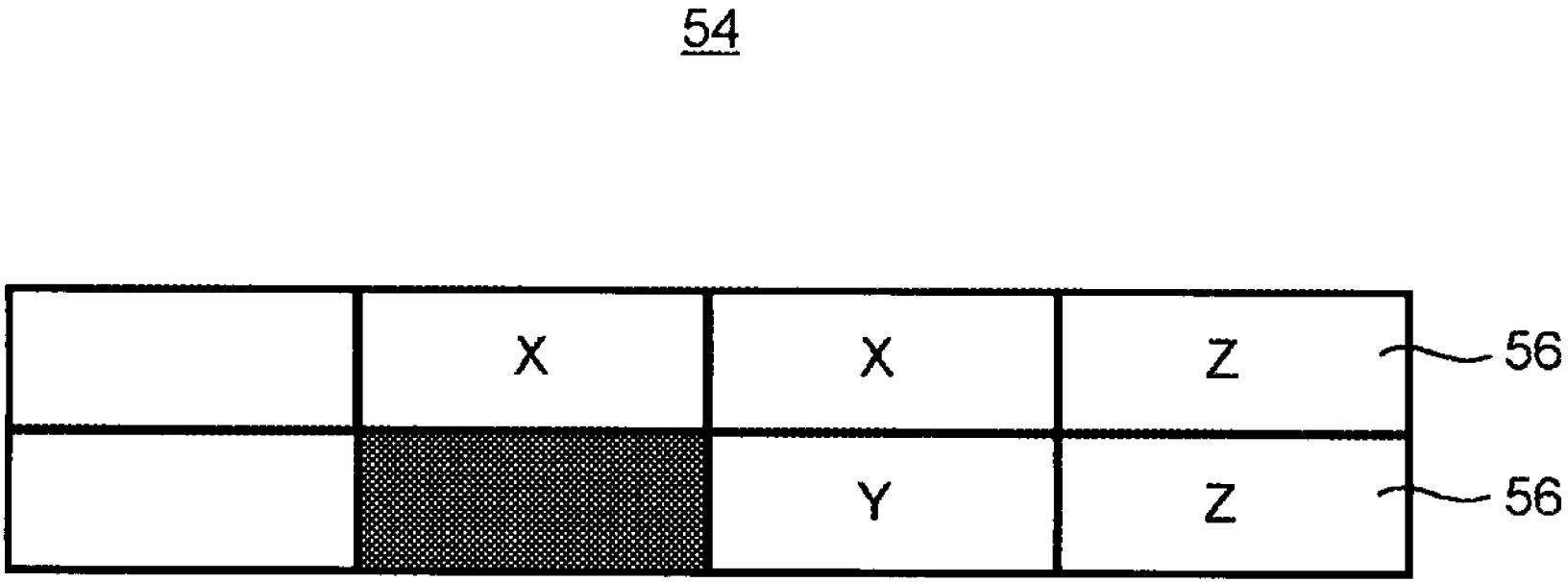
FIG. 10 an information field applied to a printing forme.

FIG. 10 shows an information field 54 of this type, and which can be applied to at least one of the printing formes 01. The information field 54 consists of multiple individual position elements 56, which are grouped according to the positions of the component, such as, for example, according to the mounting positions, on the relevant forme cylinder 06 or in the storage positions in the relevant printing forme magazine 09, in this case, for example, in two parallel rows, each containing four columns. The position elements 56 contain, and provide, information about an arrangement and/or about an operating procedure relating to at least one additional printing forme 01, which is positioned adjacent to the printing forme 01 containing the information field 54. Such information can be provided through a suitable code, such as, for example, through letters and/or numbers and/or colors. A position element 56 that is left blank indicates, for example, that no printing forme 01 will be arranged at that position. A position element that is filled in indicates, for example, that the printing forme 01 containing the information field 54 is to be arranged precisely at that position on the component which corresponds with the position element 56 in the information field 54. In accordance with, or at least similar to, the manner described above in connection with the display of the display device 52, a position marked by a symbol, such as, for example, by an "X," can indicate, for example, that a printing forme 01 has yet to be manufactured for this position. A position marked by another symbol, such as, for example, by a "Y," indicates, for example, that at the relevant position, an unexposed printing forme 01, such as, for example, a dummy plate, will be used. A position marked by a further symbol, for example, by a "Z," can indicate, for example, that no new printing forme 01 will be arranged at that position, and instead the existing printing forme 01 will be left in place there. The position elements 56 are preferably also scanned by the camera system or by the scanning device, such as, for example, by the code reader 28, as depicted in FIG. 5, and are automatically evaluated with respect to the information to be provided, for example, in an electronic evaluation unit which may be connected to the camera system or to the scanning device.

Utilizing the measures described above, a method for providing information about printing formes to be manufactured for a new production run of a printing press is provided, in which a use of at least one of these printing formes 01, at its location of use in the printing press, is visualized in a display of a display device 52. At the location of use of the relevant printing forme 01, a plurality of different positions exist. Each of those positions relates to one of multiple mounting positions on a forme cylinder 06 having the multiple mounting positions, arranged in the printing press, or relates to one of multiple storage positions in a printing forme magazine 09 having the multiple storage positions, arranged in the printing press. The display of the display device 52 displays multiple different locations of use in the printing press simultaneously. The display depicts at which of the positions of a specific location of use, and having multiple positions, a printing forme 01 is to be provided. The display also displays different states and/or properties relating to at least one printing forme 01 that has been, or at least that will be manufactured, and/or relating to a current position of the printing forme, which may be located on its transport path to the printing press. The states and/or properties displayed by the display particularly indicate whether a specific printing forme is currently located in a production line for manufacturing printing formes to be prepared for the new production run, for example, whether a specific printing forme is currently located in a plate exposure device belonging to the production line or in a developing unit or in a bending unit or in a storage device. In this case, the information which is displayed by the display, and relating to the status and/or the property of the relevant printing forme 01, advantageously results from a comparison of data. Data which is provided by the control unit 39 of a production planning system that controls the production of the printing press is compared with data collected in the production line for manufacturing the relevant printing forme 01. The information is preferably provided by a communications system 41, which system 41 connects the display device 52 to the respective control units of various other devices 33; 34; 38; 39; 42 for the purpose of data exchange. The display can be provided in an area in which a collection container 43, which receives printing formes 01 relating to a specific forme cylinder 06 or relating to a specific printing forme magazine 09, prior to their transport to the relevant forme cylinder 06 or printing forme magazine 09, is located. Alternatively, or additionally, such a display can be located at a control center 42 belonging to the printing press, or in another machine unit belonging to the printing press, and particularly in a printing unit 44; 44.1; 44.2, or on a printing tower having multiple printing units 44; 44.1; 44.2.

It is advantageous for the display of the display device 52 to simultaneously display multiple different production runs to be executed in sequence in the same printing press, with a plurality of locations of use, each display being assigned to these production runs, for the printing formes 01 required for the respective production runs. It is also advantageous for the display to display for which printing unit 44; 44.1; 44.2, each comprising a plurality of forme cylinders 06 or printing forme magazines 09 and in a printing system comprising a plurality of printing units 44; 44.1; 44.2, at least one set of printing formes 01 is complete and/or to display which of the multiple sets of printing formes 01 that are to be arranged in a specific one of the printing units 44; 44.1; 44.2 has been manufactured and is ready for use.

A device for providing information about printing formes which are to be manufactured for a new production run of a printing press is also provided, and which comprises a display device 52. A display of this display device 52 visualizes a use of at least one of the printing formes 01 at its location of use in the printing press. At the location of use of the relevant printing forme 01, a plurality of different positions are provided. Each of these positions is embodied as one of multiple mounting positions on a forme cylinder 06 having the multiple mounting positions and being arranged in the printing press, or as one of multiple storage positions in a printing forme magazine 09 having the multiple storage positions and being arranged in the printing press. The display of this display device 52 simultaneously displays a plurality of different locations of use in the printing press. The display depicts at which of the positions of a specific location of use, which has multiple such positions of use, a printing forme 01 is to be provided. The display also displays different states and/or properties relating to at least one printing forme 01 which has been, or at least which will be manufactured, and/or relating to a current position of the printing forme 01 on its transport path to the printing press.

The display device 52 is advantageously connected, by the use of a communications system 41, to the respective control units of various other devices 33; 34; 38; 39; 42; 51; 57 for the purpose of data exchange. In other words, the display device can be connected, for example, to at least one plate exposure device 33 and/or to a computer 34 of the prepress stage and/or to a bending unit 38 arranged in the production line for manufacturing the printing formes 01, and/or to a control unit 39 of a production planning system, and/or to a control center 42 belonging to the printing press, and/or to a storage device 51 that belongs to the production line for manufacturing the printing formes 01, and/or to a sorting station 57 for sorting printing formes 01.

The at least one printing forme 01, which is to be transported to a specific forme cylinder 06 or to a specific printing forme magazine 09 of the printing press is arranged in a mobile collection container 43 during the transport process. The collection container 43 that transports at least one printing forme 01 preferably provides data, at least data relating to the position currently occupied by the relevant printing forme 01 on its transport path to the printing press, to the display device 52 through the communications system 41. The collection container 43 transmits its current location continuously or at least intermittently, for example, to the display device 52. The display of the display device 52 is arranged, for example, in a control center 42 belonging to the printing press or in another machine unit belonging to the printing press, and particularly is arranged in a printing unit 44; 44.1; 44.2 belonging to the printing press.

While preferred embodiments of methods and devices for providing information about printing formes to be manufactured for a new production run of a printing press, in accordance with the present invention, have been set forth fully and completely hereinabove, it will be apparent to one of skill in the art that various changes in, for example, the specific structures of the printing units, the types of printing forme end clamping devices, the specific structures of the transport and storage assemblies, and the like, can be made without departing from the true spirit and scope of the present invention which is accordingly to be limited only by the appended claims.

What is claimed is:

1. A method for providing information about printing formes to be manufactured for a new production run of a printing press, in which a use of at least one of said printing formes (01) at its location of use in the printing press is visualized in a display of a display device (52), wherein a plurality of different positions exist at the location of use of the relevant printing forme (01), wherein each of said positions relates to one of multiple mounting positions on a forme cylinder (06) having the multiple mounting positions and arranged in the printing press, or to one of multiple storage positions in one of multiple chutes having the relevant storage position, said chutes being disposed in a printing forme magazine (09) assigned to one of the forme cylinders (06) in the printing press, wherein the display of the display device (52) displays simultaneously a plurality of different locations of use in the printing press, wherein the display displays at which of the positions of a specific location of use having multiple positions a printing forme (01) is to be provided, wherein the display also displays different states and/or properties relating to at least one manufactured printing forme (01), characterized in that the display displays simultaneously multiple different production runs to be executed sequentially in the same printing press, with a plurality of locations of use, assigned to said production runs, for the printing formes (01) that are required for the respective production runs.

2. The method according to claim 1, characterized in that the states and/or properties displayed by the display indicate whether a specific printing forme (01) is currently located in a production line for manufacturing printing formes (01) to be provided for the new production run.

3. The method according to claim 1, characterized in that the states and/or properties displayed by the display indicate whether a specific printing forme (01) is currently located in a plate exposure device (33) belonging to the production line, or in a developing unit (36), or in a bending unit (38), or in a storage device (51).

4. The method according to claim 1, characterized in that the information about the state and/or the property of the relevant printing forme (01), displayed by the display, results from a comparison of data, wherein data provided by a control unit (39) of a production planning system which controls the production in the printing press are compared with data collected in the production line for manufacturing the relevant printing forme (01).

5. The method according to claim 1, characterized in that the display presents its respective information graphically.

6. The method according to claim 1, characterized in that the display presents its respective information using at least one symbol.

7. The method according to claim 1, characterized in that the display indicates at which position in the relevant location of use a printing forme (01) is already arranged.

8. The method according to claim 1, characterized in that the display indicates to which position in the planned location of use a manufactured printing forme (01), which is ready for use but still separate from its location of use, is assigned.

9. The method according to claim 1, characterized in that the display indicates which position in the relevant location of use will not be loaded with a printing forme (01) for the pending production run.

10. The method according to claim 1, characterized in that the display indicates at which position in the relevant location of use a non-printing printing forme (01) is to be arranged.

11. The method according to claim 1, characterized in that the display indicates whether a set of printing formes (01) required for a specific forme cylinder (06) is complete.

12. The method according to claim 1, characterized in that the display indicates for which printing unit (44; 44.1; 44.2), each comprising multiple forme cylinders (06) or chutes of printing forme magazines (09), in a printing system comprising multiple printing units (44; 44.1; 44.2) at least one set of printing formes (01) is complete, and/or which of the multiple sets of printing formes (01) to be arranged in a specific one of the printing units (44; 44.1; 44.2) has been manufactured and is ready for use.

13. The method according to claim 1, characterized in that information is provided with the help of a communications system (41), which connects the display device (52) to the respective control units of various other devices (33; 34; 38; 39; 42; 51; 57), enabling them to share data with one another.

14. The method according to claim 1, characterized in that the display is provided in an area in which a collection container (43) receives the printing formes (01) relating to a specific forme cylinder (06) or a specific printing forme magazine (09), prior to the transport of said formes to the relevant forme cylinder (06) or printing forme magazine (09).

15. The method according to claim 14, characterized in that the collection container (43) for transporting at least one printing forme (01) provides data to the display device (52), via the communications system (41), said data relating at least to the position currently occupied by the relevant printing forme (01) on its transport path to the printing press.

16. The method according to claim 1, characterized in that the display is provided at a control center (42) belonging to the printing press, or in another machine unit belonging to the printing press.

17. A device for providing information about printing formes to be manufactured for a new production run of a printing press, comprising a display device (52), wherein a display of the display device (52) visualizes a use of at least one of said printing formes (01) at its location of use in the printing press, wherein at the location of use of the relevant printing forme (01) a plurality of different positions are provided, wherein each of said positions is embodied as one of multiple mounting positions on a forme cylinder (06) having the multiple mounting positions and arranged in the printing press, or as one of multiple storage positions in one of multiple chutes having the relevant storage position, said chutes being disposed in a printing forme magazine (09) assigned to one of the forme cylinders (06) in the printing press, wherein the display of the display device (52) displays simultaneously a plurality of different locations of use in the printing press, wherein the display indicates at which of the positions of a specific location of use having multiple positions a printing forme (01) is to be provided, wherein the display also displays different states and/or properties relating to at least one manufactured printing forme (01), characterized in that the display of the display device (52) displays simultaneously a plurality of different production runs to be executed sequentially in the same printing press, with a plurality of locations of use, assigned to said production runs, for the printing formes (01) that are required for the respective production runs.

18. The device according to claim 17, characterized in that the at least one printing forme (01) to be transported to a specific forme cylinder (06) or to a specific printing forme magazine (09) of the printing press is arranged in a mobile collection container (43).

19. The device according to claim 17, characterized in that the display device (52) is connected via a communications system (41) to the respective control units of various other devices (33; 34; 38; 39; 42; 51; 57) for the purpose of data sharing.

20. The device according to claim 17, characterized in that the collection container (43) for transporting the at least one printing forme (01) provides data to the display device (52), via the communications system (41), said data relating at least to the position currently occupied by the relevant printing forme (01) on its transport path to the printing press.

21. The device according to claim 17, characterized in that the display of the display device (52) is arranged in a control center (42) belonging to the printing press, or in another machine unit belonging to the printing press.

22. The device according to claim 17, characterized in that the display of the display device (52) is arranged in a printing unit (44; 44.1; 44.2) belonging to the printing press.

* * * * *